United States Patent [19]

Goepner

[11] 4,441,515

[45] Apr. 10, 1984

[54] GAMING DEVICE INCLUDING COIN DISPENSING MEANS

[75] Inventor: Siegfried E. Goepner, Carson City, Nev.

[73] Assignee: Chance Manufacturing, Inc., Las Vegas, Nev.

[21] Appl. No.: 282,260

[22] Filed: Jul. 10, 1981

[51] Int. Cl.[3] ..... G07D 9/04

[52] U.S. Cl. ..... 133/5 R; 133/8 R; 221/203

[58] Field of Search ..... 133/4 R, 4 A, 5 R, 8 R, 133/8 A, 8 C; 221/182, 183, 184, 200, 203

[56] References Cited

U.S. PATENT DOCUMENTS

| | | | |
|---|---|---|---|
| 1,096,419 | 5/1914 | Farnsworth . | |
| 1,952,563 | 3/1934 | Myers | 133/8 A |
| 3,187,760 | 6/1965 | Simjian . | |
| 3,269,503 | 8/1966 | Foster . | |
| 3,326,223 | 6/1967 | Ochi | 133/8 R |
| 3,556,531 | 1/1971 | Elder . | |
| 3,754,558 | 8/1973 | Conant et al. | 133/3 R |
| 3,770,269 | 11/1973 | Elder . | |
| 3,930,512 | 1/1976 | Woodland . | |
| 3,939,954 | 2/1976 | Collins . | |
| 3,942,544 | 3/1976 | Breitenstein et al. . | |
| 4,004,598 | 1/1977 | Bezsilko . | |
| 4,086,928 | 5/1978 | Ristvedt et al. . | |
| 4,098,280 | 7/1978 | Ristvedt et al. . | |
| 4,099,722 | 7/1978 | Rodesch et al. . | |
| 4,148,331 | 4/1979 | Nicolas . | |
| 4,173,232 | 11/1979 | Asami et al. . | |

FOREIGN PATENT DOCUMENTS

| | | | |
|---|---|---|---|
| 136877 | 6/1948 | Australia . | |
| 2210861 | 9/1973 | Fed. Rep. of Germany . | |
| 133708 | 7/1921 | United Kingdom | 133/8 R |
| 1200172 | 7/1970 | United Kingdom . | |
| 1200829 | 8/1970 | United Kingdom . | |
| 1348309 | 3/1974 | United Kingdom . | |
| 1425359 | 2/1976 | United Kingdom . | |
| 1562781 | 3/1980 | United Kingdom . | |
| 2045502 | 10/1980 | United Kingdom . | |
| 1585298 | 2/1981 | United Kingdom . | |
| 2060970 | 5/1981 | United Kingdom . | |

*Primary Examiner*—F. J. Bartuska

*Attorney, Agent, or Firm*—Lerner, David, Littenberg, Krumholz & Mentlik

[57] ABSTRACT

A gaming machine which incorporates an improved coin dispensing device for rapidly dispensing coins therefrom during a payout mode of operation. The improved coin dispensing device includes a vertically disposed hopper for storing a supply of coins to be dispensed, the hopper including a bottom exit for the coins. A guide member is supported adjacent the bottom exit of the hopper and includes a lower edge portion which defines a circular opening through which coins may be guided, the circular opening being of a first predetermined diameter. A rotatable feed disc is arranged vertically beneath the guide member for rotation about an axis substantially coinciding with the axis of the circular opening of the guide member. The feed disc includes a central hub element coaxially arranged with the axis of rotation of the feed disc and extending above the upper surface of the feed disc. The circular hub element is of a second predetermined diameter which is less than the first predetermined diameter by an amount which is approximately twice the width of the coins to be dispensed. The upper surface of the feed disc is spaced from the lower edge portion of the guide member a distance which is less than twice the thickness of the coins to be dispensed to define a coin passageway between the feed disc and the guide member through which coins supported on the feed disc may pass beneath the lower edge portion of the guide member. A closure member associated with the guide member and the feed disc is provided for substantially enclosing the outer periphery of the coin passgeway between the feed disc and the guide member. The closure member includes a lateral outlet slot communicating with the passageway between the feed disc and the guide member through which coins fed into the passageway are directed upon rotation of the feed disc.

42 Claims, 16 Drawing Figures

FIG.9
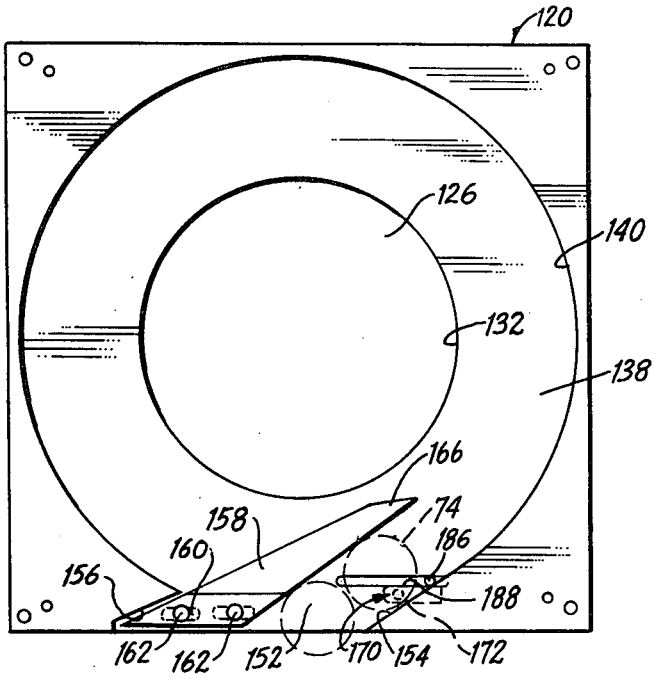
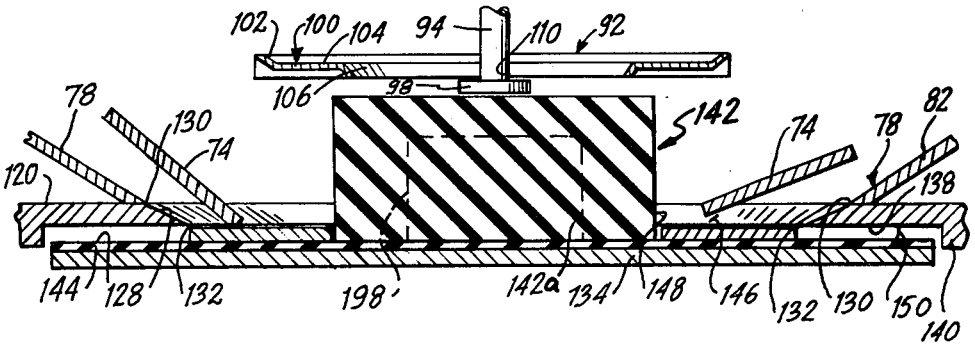
FIG.10

GAMING DEVICE INCLUDING COIN DISPENSING MEANS

FIELD OF INVENTION

The present invention relates to gaming machines or devices in general, and more specifically to a gaming device which includes coin dispensing means for dispensing of coins therefrom during a payout mode of operation. Still more particularly, the gaming device of the present invention is operative to receive different denominations of coins and to effect a payout of coins in a like denomination and number as the coins received by the gaming device. The gaming device of the present invention also includes an improved coin dispensing device for more rapidly dispensing coins.

BACKGROND OF INVENTION

Many different gaming devices are known in the prior art which are operative to be actuated upon receipt of a coin being deposited therein to generate one of a plurality of different chance conditions or combinations, and to then automatically dispense, according to preselected odds, coins when one or more specific chance conditions are produced during the play cycle or mode of the device. For instance, one typical class of gaming devices of this type, commonly known as poker machines, fruit machines or slot machines, generally comprises a plurality of coaxially mounted rotatable drums or reels, usually three in number. Each of the drums or reels has on its periphery a variety of different symbols or features. During the play of these types of devices, the drums or reels are caused to rotate when a player actuates a lever or depresses a starting button, the lever or start button being rendered operative by the depositing of a coin in the device. At the end of a normal play cycle, the drums or reels are randomly arrested by suitable electrical or mechanical means. The different symbols on the various drums form various combinations of symbols in the viewing area of the machine, certain ones of which are designated winning combinations. If a winning combination is detected by the device, the player is entitled to an award or prize which is then automatically dispensed by the device. If the particular combination produced during any play cycle is not a winning combination, no coins are dispensed.

It will of course be appreciated that there are a wide variety of different types of gaming devices which are operative to produce a variety of different combinations of symbols or features in one fashion or another, and in which the various different combinations are either defined as a winning combination (in which event coins or an award is dispensed) or a losing combination (in which event no award is dispensed). Typical examples of some of these types of gaming devices or machines are shown in U.S. Pat. Nos. 4,097,048; 4,184,683; 4,066,264; 3,759,525; and 2,044,320. It will also be appreciated that a wide variety of different mechanisms are known in the prior art for actuating or rotating the reels or drums and for stopping or arresting such rotation, as well as for detecting which symbol or symbols are displayed in the viewing area of the device after the reels have been arrested so as to determine whether the combination of symbols displayed is a winning combination, or a losing combination. Furthermore, it is also well known in the art that different ones of the winning combinations may pay out different values of prizes or awards. Still further, many different mechanisms for ensuring a randomness of the combinations produced upon any given play are similarly well known in the art.

Over the years, these types of gaming devices have proven to be quite popular since a player may simply deposit his coin or bet in the machine and determine, in a relatively short period of time, whether or not his play has resulted in a win or a loss. When a winning combination is produced, the gaming device immediately pays out a suitable number of coins into a payout hopper; if a losing combination is produced, the gaming device simply retains the player's bet or coins.

With many of the commercial gaming devices of this type which are used by casinos or gaming houses, or in other establishments which permit the operation of such devices, the machines are designed so that the owner of such machines receive a certain percentage of the amount of money which players place into the machines to play them. This is generally accomplished, as is well known in the art, by choosing the payout odds—i.e., the ratio of the amount of money the machines payout for a win combination to the amount of money bet or deposited for a particular play—to be less than the odds for particular combinations which may be produced during any given play. For instance, if the odds that a particular combination will be produced are 625-to-1, the machine may only pay out at a ratio of 400-to-1.

It will therefore be appreciated that the value or the take of these types of gaming devices is dependent on the amount of money which is deposited by players to play the device. Consequently, it is desirable that the length of time for a particular play cycle, including the pay cycle, be kept to a minimum so that during a given period of time a greater number of plays may be made with the device. That is, as the amount of money which is retained by the house or the owner of the machine is dependent upon the length of each play cycle, including the payout cycle, it is desired that the time required to complete a play be kept to a minimum. Generally, with most commercial gaming establishments, the payout odds for slot machines and the like are governed by the states' gaming commissions or other suitable authority.

Although various techniques have been employed for shortening the time to produce a particular combination during the play cycle, one of the factors greatly affecting the amount of the take of gaming devices has been the time required to complete a payout operation, since during the payout mode of operation, the gaming device may not be used for another play or round. In this regard, the amount of the payout for gaming devices is generally a multiple of the amount of money inserted by a player, i.e., for one quarter inserted into the device, the payout may be anywhere from 5 to 500 times the value of the coin. Further, dispensing devices for gaming machines generally function to dispense coins one at a time during the payout sequence or mode of operation. Therefore, it will be appreciated that in a payout operation, the length of time to effect a payout is directly proportional to the number of coins to be dispensed. Accordingly, in order to minimize the amount of time required to payout coins upon a win condition being detected (and thus to minimize the amount of time that the machine can not be used to receive further bets or coins), it is desired to provide a dispensing device which is capable of dispensing coins one at a time at a great rate of speed. This then shortens the amount of time that the machine cannot be used for playing another cycle or round, and in turn creates the possibility of maximizing the number of coins or plays which may be made with a particular gaming device.

Another factor affecting the profitability of a gaming device is the fact that conventional gaming devices generally only function for a given denomination of money, i.e., different gaming devices or machines are provided for different denominations of coins. For instance, a particular gaming device might comprise a nickel machine which is operated with nickels and pays out in nickels, while a second machine functions as a dime machine which is played with dimes and pays out in dimes, and still a third and further machines function with quarters and half-dollars, etc. While at least one prior art device (shown in British Pat. No. 1,348,309) has been designed to accept a variety of different denominations of coins, generally depositing of coins of higher denominations in such machines only serves to either increase the number of plays which may be made with the device (i.e, depositing of a quarter in a nickel slot machine would permit five continuous plays without having to insert additional coins), or increase the number of lower denomination coins paid out during a payout condition (i.e., depositing of a quarter in a nickel machine would result in a payout, upon a winning condition being sensed, of a payout in nickels at the rate of five times the payout odds).

As noted above, the profitability of gaming machines is dependent upon the amount of money which a player has inserted to play the gaming devices. Thus, it might be expected that use of larger denominations of coins inserted into such prior art gaming devices would serve to increase the take or profitability of the gaming device. However, when such gaming devices only serve to increase the credit or number of plays which could be made when larger denomination of coins are utilized, the effect is no different than if a corresponding quantity of lower denomination coins were inserted. Accordingly, when such gaming devices are operated on this principle, the profitability would not be increased. Similarly, if the gaming devices function to simply increase the payout in lower denomination coins when larger denomination coins are utilized, since the dispensing device only dispenses one coin at a time, the length of time of the payout cycle simply increases, and correspondingly reduces the profitability of the machine.

Still further in this regard, since different gaming machines in the prior art are generally utilized for different denomination of coins, in order to provide a variety of machines capable of being operated with different denominations of coins, the number of machines has had to be increased. As can be appreciated, this also can greatly affect the profitability of slot machines and similar gaming devices. In particular, in the past, if a player had only one coin which he wished to play, the player would have to search for a gaming machine capable of receiving the particular denomination of such coin. Similarly, if a player had several different denominations of coins he wished to play, the player would have to search for several different denomination machines. Such required searching in a casino having several hundred gaming devices can be most discouraging, and often players having only one or a few coins left might simply leave the casino without making any further plays.

The present invention is designed to overcome and minimize the above noted and other disadvantages of the prior art, and in particular, to provide a gaming device which may be utilized to increase the profitability of such a gaming device by decreasing the length of time required for a payout operation and/or by increasing the versatility of the gaming devices by their being adapted to handle a variety of different denominations of coins either individually or at the same time.

SUMMARY OF THE INVENTION

In accordance with one aspect of the present invention, there is provided a coin dispensing device, which may be used in a gaming machine, for dispensing of coins of a predetermined width and thickness. The coin dispensing device comprises a hopper for storing a supply of coins to be dispensed, the hopper including bottom guide means for guiding of coins through the bottom of the hopper. The bottom guide means includes a lower edge portion which defines a circular opening through which coins in the hopper are to be guided, the circular opening being of a first predetermined diameter. A rotatable feed disc is arranged beneath the guide means for rotation about an axis substantially coinciding with the axis of the circular opening of the guide means, the feed disc including a central hub element coaxially arranged with the axis of rotation of the feed disc and extending above the upper surface of the feed disc. The circular hub element is of a second predetermined diameter which is less than the first predetermined diameter of the opening by an amount which is approximately twice the predetermined width of the coins to be dispensed. The upper surface of the feed disc is spaced from the lower edge portion of the guide means a distance which is less than twice the predetermined thickness of the coins to be dispensed to define a coin passageway through which coins supported by the feed disc may pass beneath the lower edge portion of the guide means. Rotation means are provided for rotating the feed disc to urge the coins supported thereon radially outward beneath the guide means. Closure means are provided associated with the guide means and the feed disc for substantially enclosing the outer periphery of the coin passageway between the feed disc and the guide means. The closure means includes a lateral outlet slot communicating with the passageway between the feed disc and the guide means through which coins fed into the passageway are directed upon rotation of the feed disc.

With such an arrangement, the guiding and feeding of coins from the hopper may be accomplished at a much faster rate than with conventional coin dispensers, such that the time required for dispensing a given number of coins may be significantly reduced or minimized. In particular, in accordance with the present invention, coins guided onto the feed disc are immediately moved radially outward upon rotation of the feed disc beneath the guide means and from there through the outward slot in the closure means. It is important in accordance with this aspect of the present invention that the distance between the lower edge portion of the guide means and the outer circumferential surface of the central hub element (i.e., the width of the annular space defined between the central hub element and the lower edge portion) corresponds substantially to the width of the coins to be dispensed so that coins will not become jammed on the feed disc, and thereby be prevented from smoothly passing beneath the lower edge portion of the guide means upon rotation of the feed disc. In other words, in accordance with this aspect of the present invention, the lateral spacing between the lower edge portion defining the circular opening in the guide means and the circumferential edge of the central hub element is such that only one coin at any particular circumferential location drops onto the feed disc to then be urged radially outward beneath the lower edge portion into the coin passageway. Further, by virtue of the fact that an annular space is provided between the central hub element and the guide means, a number of coins may be deposited onto the feed disc about the circumference of the annular space. At any particular circumferential location however, only one coin will be supported on the feed disc so as to be in position to pass beneath the lower edge portion of the guide means.

In the preferred embodiment, the hopper is disposed vertically, and agitating and support means are provided for aiding the feed of coins to the annular space between the central hub element and the guide means so that the coins will be guided in a substantially flat horizontal orientation and placed substantially flat on the feed disc, as opposed to being placed edge-wise thereon. In the preferred embodiment, the agitating and support means comprises a fan-like agitator element having a plurality of blades which are shaped so that as the coins pass therearound, they are guided into a generally horizontal orientation. The agitator element is arranged substantially coaxially with the feed disc and the guide means and is vertically spaced from the central hub element, whereby the coins in the hopper pass downwardly around the agitator element and onto the feed disc in a substantially horizontal orientation. Also, advantageously, the guide means includes an inclined surface for directing the coins downwardly toward the circular opening in the guide means.

According to another aspect of the present invention, there is provided a gaming device which comprises coin receiving means for receiving different denominations of coins and for receiving one or more coins of each of the denominations, and chance means for randomly generating a plurality of chance conditions, at least one of the chance conditions representing a win condition. The chance means is responsive to the coin receiving means receiving at least one coin. Sensing means are also provided for sensing when the chance means produces a win condition. A plurality of coin containing means corresponding in number to the different denominations of coins intended to be received by the coin receiving means are also provided, each of the coin containing means containing a supply of coins of one of the different denominations of coins. Coin determining means are also provided for determining the denomination of the coins and the number of coins of each denomination received by the coin receiving means. Dispensing means are provided for dispensing of coins from the plurality of coin containing means upon a win condition being sensed by the sensing means. The dispensing means is responsive to the coin determining means so as to dispense coins from those coin containing means which correspond to the denominations of coins received by the coin receiving means, the number of coins of each denomination being dispensed by the dispensing means corresponding to a predetermined manner to the number of coins of each denomination received by the coin receiving means. In this manner, when a win condition is sensed, coins are dispensed of a like denomination as those received by the coin receiving means, and in a number corresponding to the number of coins of each denomination received by the coin receiving means.

Thus, in accordance with this aspect of the present invention, if quarters and dimes are initially received by the gaming device, and a win condition is produced, then quarters and dimes, in numbers corresponding to the number of quarters and dimes initially inserted onto the device, will be dispensed during a payout mode of operation. In this regard, in a preferred embodiment, the dispensing means comprises a plurality of individual dispensing devices corresponding in number to the number of coin containing means. When a win condition is sensed, the appropriate individual dispensing devices are operated to dispense coins from their respective coin containing means, the particular individual dispensing devices which are operated being those which correspond to the denominations of the coins initially received by the coin receiving means. Still further in accordance with the preferred embodiment, the dispensing means include a plurality of payout hoppers into which the coins are dispensed, each hopper corresponding to one of the denominations of the coins intended to be received by the coin receiving means.

Therefore, in accordance with this aspect of the present invention, it will be appreciated that a single gaming device may be used in the manner of a plurality of gaming devices of different denominations simply by inserting different denominations of coins into the coin receiving means. Thus, for example, the gaming device may be used as a quarter machine, or as a half-dollar machine, or as a quarter and half-dollar machine for a single play. If a particular play results in a win condition, then the gaming device serves to dispense or payout coins of a like denomination as those coins initially received, the number of coins of each particular denomination corresponding to the number of coins initially deposited into the gaming device.

These and other features and characteristics of the present invention will be apparent from the following detailed description in which reference is made to the enclosed drawings which illustrate a preferred embodiment of the present invention.

BRIEF DESCRIPTION OF DRAWINGS

FIG. 9 is a bottom plan view of the guide plate member of the coin dispensing unit shown in FIGS. 4 and 5.

FIG. 10 is an enlarged side elevational view of a portion of the coin dispensing unit shown on FIG. 5, illustrating how coins are fed onto the feed disc thereof and moved radially outward beneath the lower surface of the guide plate member.

DETAILED DESCRIPTION OF THE PREFERRED EMBODIMENT

Figure 1:
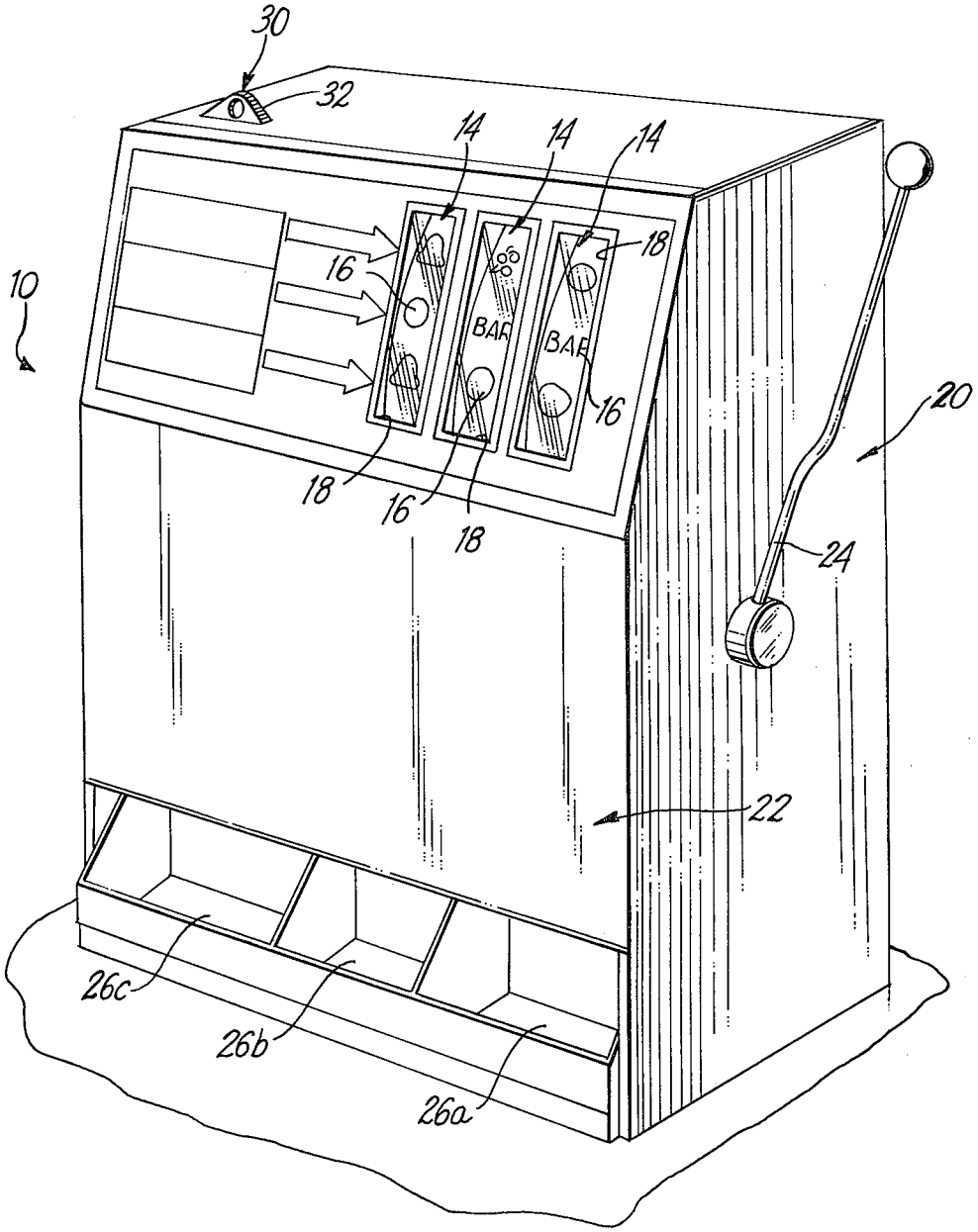
FIG. 1 is a perspective view of the gaming device in accordance with the present invention, and which incorporates coin dispensing devices in accordance with the present invention.
Figure 2:
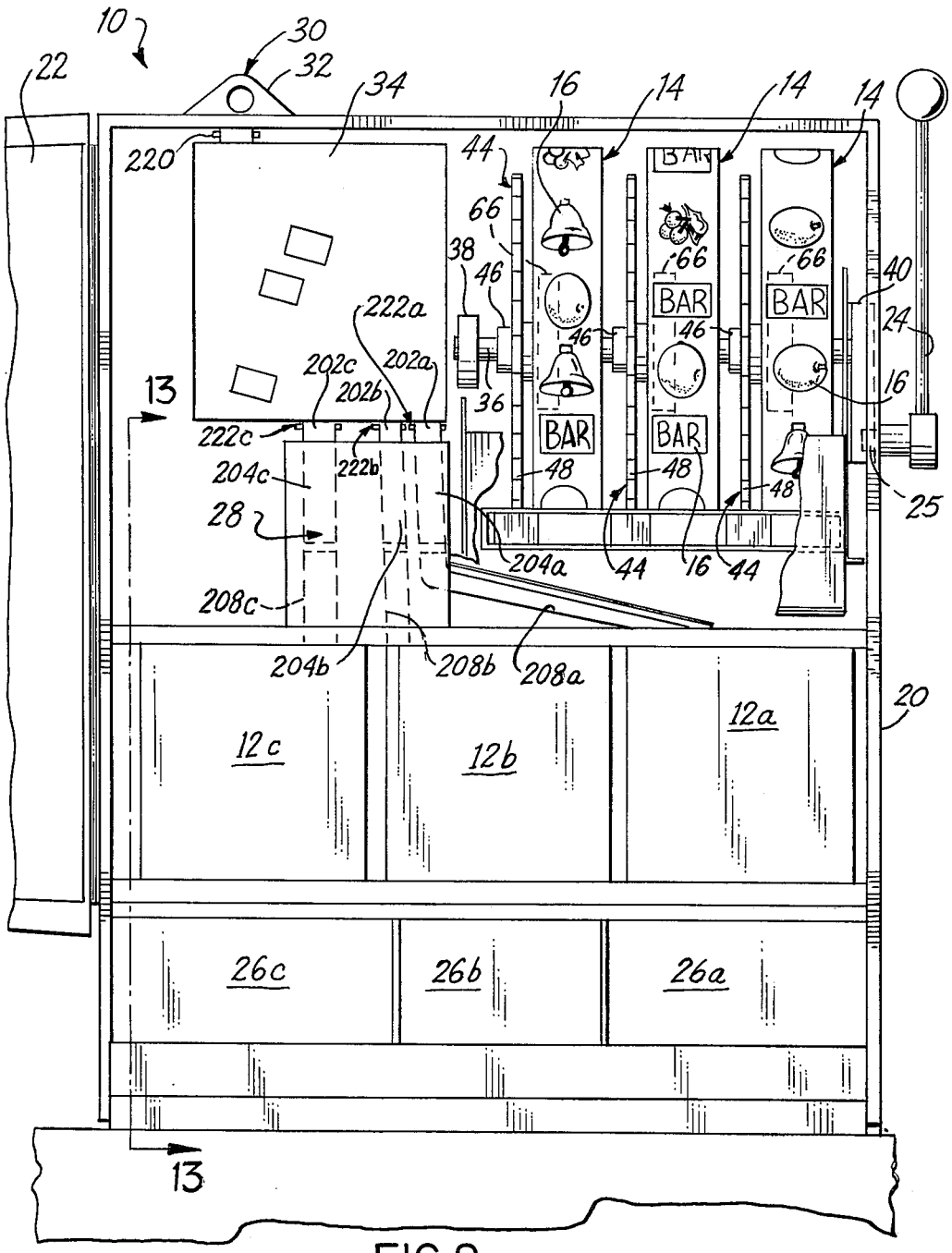
FIG. 2 is a schematic front elevational view of the gaming device of FIG. 1 with the front cover thereof removed to illustrate various components therewithin.

Referring now to the drawings wherein like reference characters represent like elements, there is shown in FIGS. 1 and 2 a gaming machine 10, including coin dispensing means 12*a*, 12*b*, 12*c*, in accordance with the present invention. Although the present invention will be described herein below with reference to the particular type of gaming machine 10, shown in FIG. 1, it will be appreciated by those skilled in the art that the present invention could be utilized with other different types of gaming or chance devices, both those which operate under different principles entirely, and those which, although similar to that illustrated in FIG. 1, contain different elements or mechanisms. In particular, the gaming device 10 in accordance with the present invention does not require any specific types of chance selection or generation mechanism, or specific devices to generate a win condition signal. For instance, the particular chance combinations or conditions may be of a wide variety of different forms, and the particular mechanism or mechanisms for generating the desired randomness may likewise vary. Rather, the present invention is directed generally to gaming devices 10 of the type which requires one or more coins to be deposited to operate same so as to generate one of a plurality of different chance combinations or conditions, at least one of which constitutes a win condition, and to then payout, generally according to preselected odds, one or more coins depending upon the win condition being sensed by the machine 10.

With respect to the particular example of the gaming device 10 illustrated in FIG. 1, it will be noted that the gaming device 10 is of the general type which includes a plurality of drums or reels 14 carrying representations of symbols, letters, numbers or other indicia 16 on their peripheries, the drums or reels 14 being arranged or assembled in a linearly spaced array along side of one another and being free to rotate independently of each other. Each of the three reels 14 may be independently arrested after actuation or rotation so as to display visually in an associated window or windows 18 of the housing 20 a particular symbol or other indicia 16. In the preferred embodiment, and as is conventional, the particular indicia 16 appearing on each of the windows 18 along a common row defines a particular chance combination or condition. As is known, many different chance combinations or conditions could be generated randomly with such a device 10 since rotation of each of the reels 14 is independently arrested and since each of the reels 14 contains a plurality of representations or symbols 16 thereon, such as for example, 20 indicia, some of which may be duplicates. In the preferred embodiment, the row of indicia 16 appearing in the middle of each of the windows 18 defines the particular chance condition or combination, which is sensed to determine whether a win condition exists. However, as is well known, the top row of indicia or symbols 16, or the bottom row, or even a row defined along a diagonal, could be utilized if desired. This is a preselected condition set by the owner of the device 10.

The gaming device 10 illustrated in FIG. 1 includes a suitable housing or casing 20 which includes an operable front panel 22 for affording access to the interior of the device 10. The front panel 22 includes three viewing windows 18 through which portions of the periphery or rim of the respective rotatable reels 14 are visible. An external, lever-type handle 24 is mounted on the right hand side of the casing 20, and may be pulled forwardly to commence play of the device 10. The lower base of the housing 20 includes plurality of payout hoppers 26*a*, 26*b*, 26*c*, commonly called money bowls into which coins are dispensed if a winning combination is produced during any particular play of the device 10. Further, the casing 20 includes thereon suitable coin receiving means 30 for receiving a plurality different denominations of coins. In the embodiment shown in FIG. 1, the coin receiving means comprises a coin receptacle on slot 32 along the top surface of the casing 20, the coin slot 32 being adapted to receive coins of different denominations and to pass some downwardly through an acceptor mechanism 34 (see FIG. 2) for the purpose of releasing a lock (not shown) within the device to permit the handle 24 to be coupled to the reel actuating mechanism 40 to actuate the reels 14 for rotation. In this regard, as is conventional, the handle 24 is normally free running and may only be coupled to effect a play cycle after at least one coin has been deposited in the coin slot 32.

Although a single coin slot 32 and associated coin acceptor mechanism 34 have been illustrated in the embodiment shown on FIG. 1, it will be appreciated that other types of coin receiving means or acceptors could be provided for providing for receipt of a plurality of different denominations of coins, such as for example, a plurality of coin slots into which different denominations of coins could be inserted, e.g., a first slot for quarters, a second slot for dimes and a third slot for nickels. Coin acceptors capable of receiving a number of different denominations of coins are well known in the art, and any such suitable coin acceptor could be employed in the gaming device 10 in accordance with the present invention for receiving coins and releasing a suitable locking mechanism. In this regard, the coin acceptor mechanism 34 may be either of the electrical type, the mechanical type or a combined electrical-mechanical type.

Within the housing 20 of the gaming device 10, each of the reels or drums 14 is rotatably mounted on a common shaft 36 which in turn is journalled at one end in suitable bearings 38 and at the other end is operatively connected to the actuating mechanism or means 40. Each reel 14 includes a suitable clutch mechanism (not shown) to effect driving engagement between the shaft 36 and the reels 14. Such clutch mechanisms are known in the art, and may take any suitable form. For example, U.S. Pat. Nos. 2,087,709 or 4,066,264 disclose overrunning or unidirectional clutch mechanisms for drums or reels of gaming devices in which the reels are supported so as to be rotatable in only one direction with respect to the shaft, and to be fixed to rotate with the shaft in the opposite direction. In this manner, the shaft may be rotated quickly in one direction to thereby impart rotational momentum to the reels. When the shaft is arrested, the reels continue to rotate in the same direction until they are arrested by a suitable stopping mechanism as is conventional. The actuating mechanism 40 for rotating the shaft 36 is interposed between the shaft 36 and the externally mounted handle 24 and is adapted to be coupled to the handle 24 when a suitable locking means (not shown) has been released (e.g., after a coin has been deposited). The actuator mechanism 40 and coupling of same to the handle 24 may take any suitable form. For instance, suitable actuating mechanisms for operatively connecting a handle to a shaft to effect rotation thereof are shown in U.S. Pat. Nos. 3,464,693 and 4,097,048. Of course, it will be appreciated that other types of actuating mechanisms or means could be utilized, even those which do not employ an external handle for causing rotation of the shaft 36. Similarly, the locking mechanism could take any suitable form, such as deenergization of a locking solenoid or other electronics. In this instance, release of the locking mechanism could be accomplished by energization of the lock mechanism, solenoid or electronics.

Figure 3:
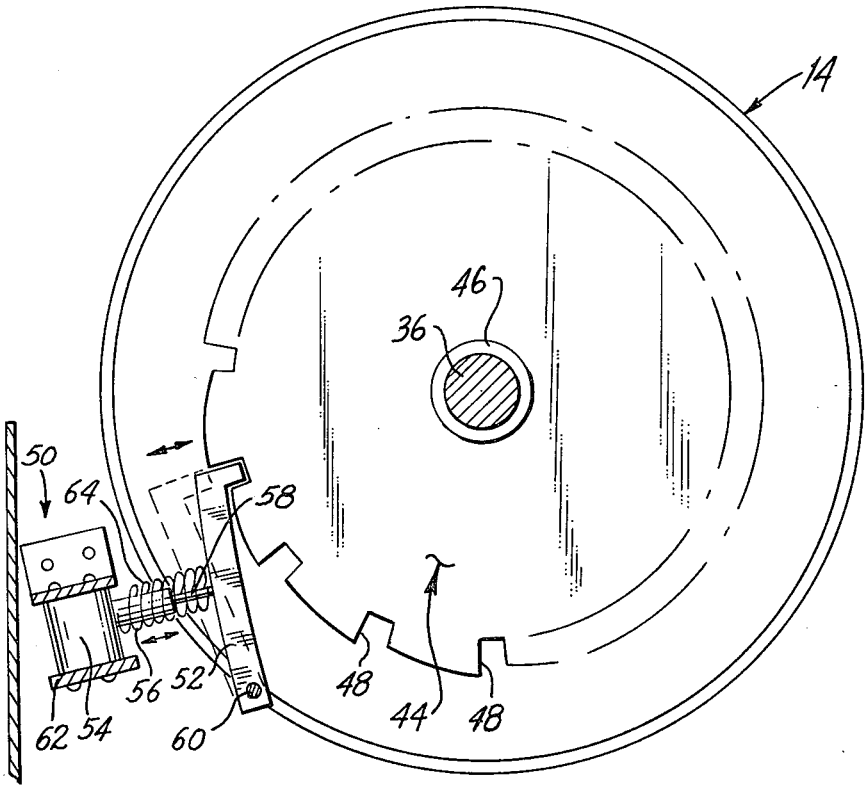
FIG. 3 is a schematic side elevational view of a reel assembly, and a stopping mechanism therefor, which may be utilized in the gaming device shown on FIG. 1.

The gaming device also includes suitable means for arresting or stopping rotation of each of the drums or reels 14 so that at least one of the indicia or symbols 16 thereon is visible in each of the respective windows 18 of the housing 20. For instance, as shown in FIGS. 2 and 3, a toothed concentric disc may be supported for rotation with each drum or reel 14, such as for example, by means of a mounting collar 46. The concentric discs 44 are each provided with a series of notches 48 about their peripheries, each corresponding to one of the symbols 16 on the associated drum or reel 14 There is also associated with each of the respective reels or drums 14 an engaging means 50 for engaging one of the notches 48 on its associated concentric disc 44 to thereby stop rotation of the disc 44 and its associated reel or drum 14 during any particular play. As best shown in FIG. 3, each of the engaging means 50 in the preferred embodiment, comprises a pivotably mounted pawl member 52 and an associated solenoid 54, having an armature 56 connected to its associated pawl 52 through a link 58. The three pawl members 52, one for each reel 14, are pivotaly mounted on an associated shaft 60, and the associated solenoids 54 are in turn mounted on a common support plate 62. Each pawl 52 is biased by a spring 64 in the direction of its respective concentric disc 44.

At the beginning of each play circle, each solenoid 54 is energized to maintain the respective pawls 52 out of engagement with the concentric discs 44. This could be accomplished by first detecting the handle 24 being pulled forwardly after coupling of the actuating mechanism 40 to the handle 24, and then energizing the solenoids 54. Movement of the handle 24 forwardly can be detected by any suitable means, such as for example, by a switch or sensing device 25 associated with the actuating mechanism 40 (see page 2). During the play cycle, and after the reels 14 are rotated, the solenoids 54 are deenergized by suitable means. When the solenoids 54 are deenergized, the associated springs 64 cause the associated pawls 52 to rock in a clockwise direction, as viewed in FIG. 3, to engage the associated concentric discs 44 to arrest rotation of the associated drums or reels 14. Such stopping means are known in the art, such as for example in U.S. Pat. No. 4,184,683. In this regard, it will of course be appreciated that there are a wide variety of suitable means which could be employed for arresting rotation of the respective reels 14 during any play cycle, FIG. 3 merely illustrating one such arresting means which could be employed.

The gaming device 10 also includes suitable detector means 66 associated with each of the reels 14 for detecting the position of the reels 14 after they have been arrested, and more particularly for detecting the symbols or other indicia 16 on the rim of the reels 14 which appear in a horizontal line through the windows 18 in the housing 20. The detecting means 66 may be of any conventional type utilized in the prior art for detecting the individual stop positions of the reels or drums 14 and for generating appropriate signals for controlling a dispensing or payout mechanism depending upon the particular combination of symbols or other indicia 16 appearing through the windows 18 of the machine 10. For instance, the detecting means 66 could comprise suitable photoelectric sensing means which cooperate with each of the reels or drums 14 for reading the reel stop positions (such as for example, shown in U.S. Pat. No. 4,138,114), a photo-optical apparatus which operates in conjunction with holes formed in the respective concentric discs 44 or in the reels 14 (such as for example, shown in Great Britain Pat. No. 2,031,632A), or electrical contact apparatus employing wiper elements for engaging or contacting appropriate contact points provided for on the concentric discs 44 or reels 14 (such as for example, shown in U.S. Pat. No. 3,913,922). Still further arrangements or mechanisms for detecting the stop positions of the reels 14 are known in the prior art and could be employed, for instance those shown and described in U.S. Pat. Nos. 3,658,340; 3,913,922; 3,610,629; and 2,634,130.

Basically, the function of the detecting means 66 is to detect the particular symbol or indicia 16 which is visible through each of the windows 18 on the device 10, and to generate a corresponding signal for each of the reels 14, which is applied to an appropriate control unit which thereby determines the particular combination of symbols 16 which are visible through the windows 18 of the device 10. If the particular combination is a winning combination, the control unit will then generate an appropriate signal for actuating the dispensing means **12*a*, 12*b*, 12*c* for dispensing or paying out coins into the payout hoppers 26*a*, 26*b*, 26*c* of the device 10. In this regard, it is known in the art that the particular winning combinations which will generate payout signals may be varied for the gaming device 10**. Still further, it is known that different winning combinations may generate different payout awards.

Suitable means for determining whether a particular combination is a win combination and for generating an appropriate control signal for activating the dispensing means are well known in the art and, therefore, need not be described in detail herein. Here, it should be recalled that, in accordance with one aspect of the present invention, the gaming device 10 is operative to receive coins of different denominations and to receive more than one coin of each denomination, and then to payout, upon detection or sensing of a win condition, coins of the like denomination and in a number corresponding the number of coins of each denomination received by the gaming device 10. Thus, the control unit or mechanism for accomplishing this function will be described in more detail hereinbelow.

However, the basic technique employed by the control unit to sense a winning condition and for generating an appropriate signal or signals to the dispensing means 12*a*, 12*b*, and 12*c* may be of a conventional design and, therefore, will not be described.

Also in accordance with the present invention, the gaming device 10 shown on FIG. 1 employs novel coin dispensing units 12*a*, 12*b*, 12*c* for dispensing of coins into the payout hoppers 26*a*, 26*b*, 26*c* at a much greater rate than is provided with conventional prior art coin dispensing units, and which dispensing units 12*a*, 12*b*, 12*c* occupy significantly less space than prior art devices or units. Here, it should be noted that although the coin dispensing units 12*a*, 12*b*, 12*c* of the present invention will be described with reference to their employment in a gaming device, one or more of the dispensing units could be employed in other machines or devices, such as for example, change dispensing machines.

Figure 4:
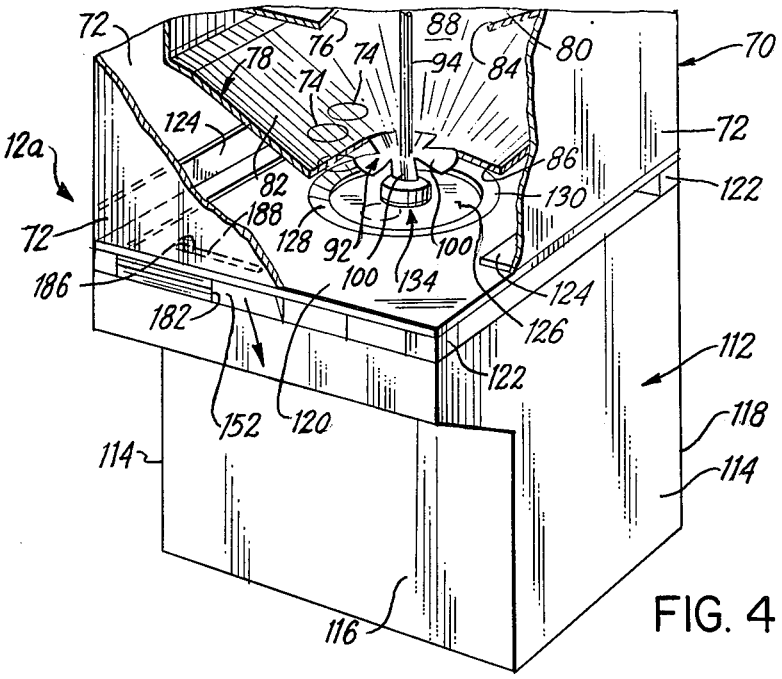
FIG. 4 is a perspective view of one of the coins dispensing units which may be utilized in the gaming device shown on FIG. 1, various portions thereof being broken away to illustrate various elements.

The preferred embodiment of one of the coin dispensing units 12*a* for dispensing one denomination of coins will now be described with reference to FIGS. 4–12 of the drawings, that is, it being understood that the dispensing units 12*b* and 12*c* are of a similar design for dispensing other denominations of coins respectively. FIG. 4 illustrates a perspective view of one coin dispensing unit in accordance with the preferred embodiment of the present invention, three such units being provided in the preferred embodiment of the gaming device 10 of the present invention, one for each of the three different denominations of coins which may be dispensed by the gaming device 10 upon sensing of a win condition. Here it will be appreciated however that one, two, or more than three, dispensing units 12 could be provided in one gaming device or change dispensing machine if desired. Also, all dispensing units 12 in a single machine could be used for one denomination of coin, thus resulting in a greater coin capacity per device, and the ability to payout larger jackpots.

Each of the coin dispensing units 12*a*, 12*b*, 12*c* are arranged internally within the machine 10 at an elevation below the coin acceptor 34 and the rotatable reels or drums 14 (see FIG. 2). In particular, the coin dispensing units 12*a*, 12*b*, 12*c* are arranged in side-by-side relationship to one another, and located directly above the payout hoppers 26*a*, 26*b*, 26*c* into which the coins to be dispensed by the dispensing units will be directed.

Figure 6:
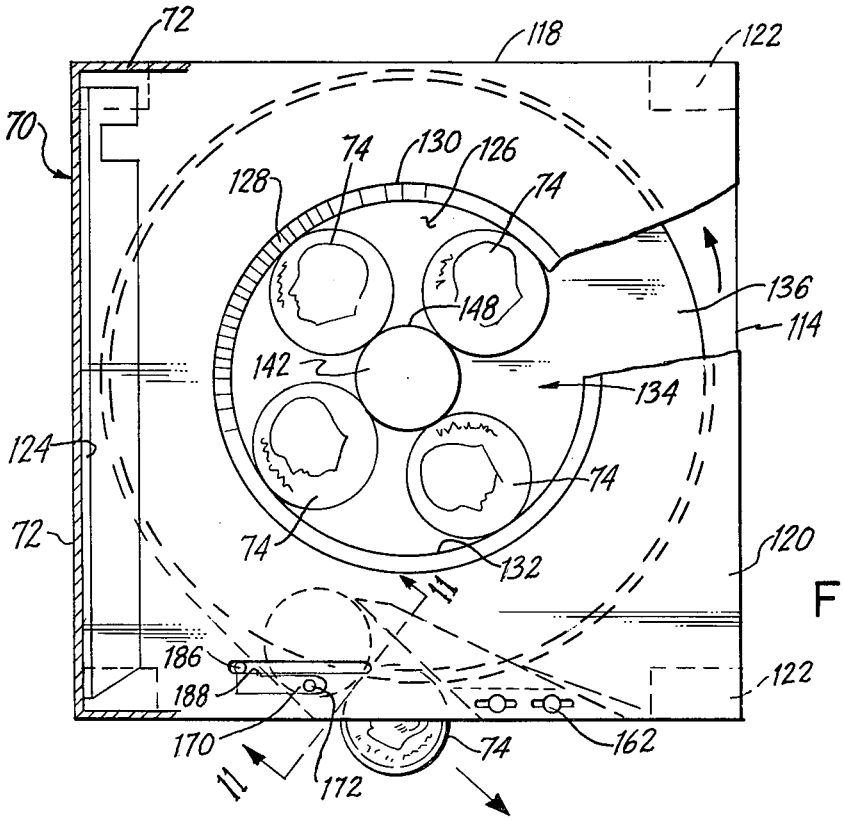
FIG. 6 is a top sectional view taken along lines 6—6 of FIG. 5.
Figure 5:
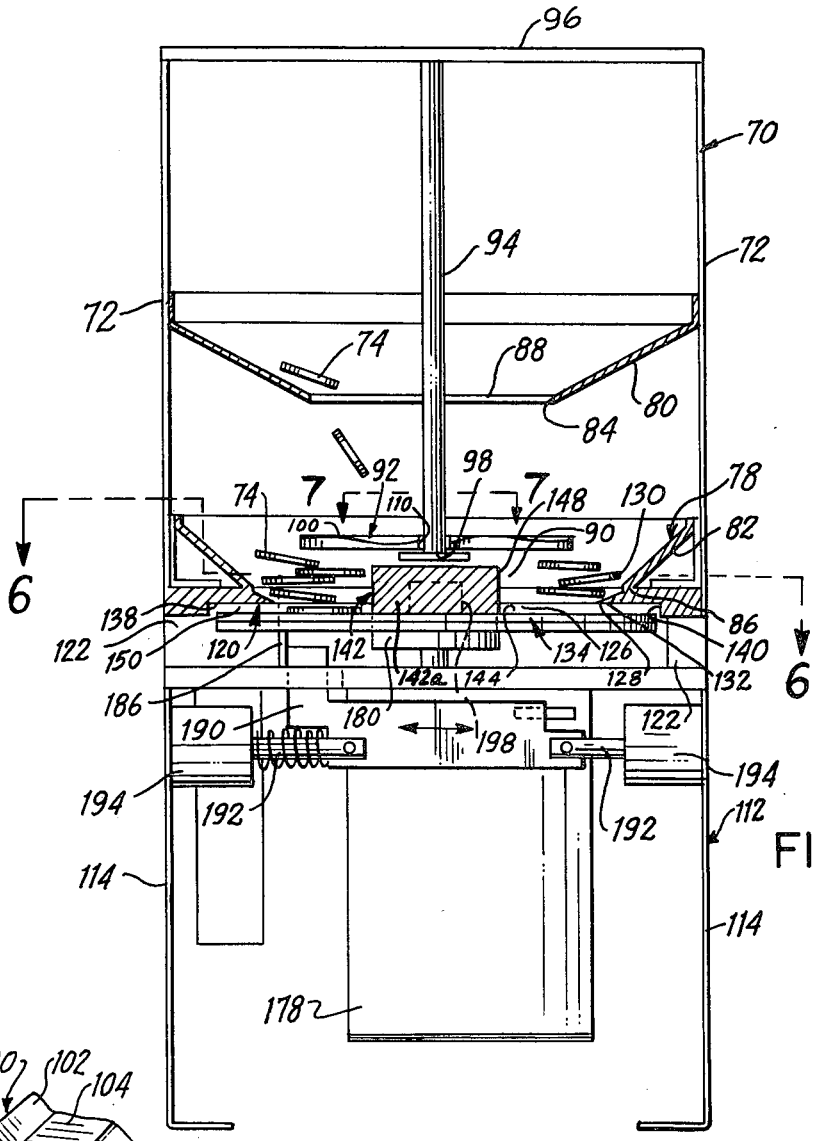
FIG. 5 is a schematic front sectional view of the coin dispensing unit shown on FIG. 4.

The coin dispensing unit 12*a* includes a vertically arranged hopper section 70 defined by upstanding side walls 72 and having a generally square configuration, as shown best with reference to FIGS. 4–6. It will be appreciated however that the hopper section 70 could have a round or other suitable shaped configuration. The height of the side walls 72 of the hopper section 70 is designed so as to provide a receptable for a suitable number of coins 74 which are either initially placed or loaded thereinto prior to the gaming device 10 being put into operation or diverted thereinto by a coin diverter unit 28 as will be described more fully hereinbelow. In this regard, the number of coins 74 in the hopper section 70 should be sufficient so that during operation, the dispensing unit 12*a* will generally always be capable of dispensing or paying out the largest possible payout which may be generated during any given play of the gaming device 10. In other words, the number of coins 74 in the hopper section 70 should be sufficiently in excess of the largest possible payout such that the gaming device 10 will not have to shut down after every payout of the maximum number of coins 74.

A pair of generally funnel-shaped hopper guides 76, 78 are supported internally of the hopper section 70 by the side walls 72 in vertically spaced relationship for generally directing and guiding coins 74 received in the open upper end of the hopper section 70 downwardly toward a bottom exit opening. In this regard, the hopper guides 76, 78 in the preferred embodiment have generally rectangular or square shaped outer peripheral edges which correspond in size and shape to the configuration of the side walls 72, and are attached thereto by suitable means, such as for example, bolts, screws, or spot welds or other suitable means (not shown). Each of the hopper guides 76, 78 includes a downwardly directed portion or surface 80, 82 which terminates at its other end in a lower edge 84, 86 which defines a generally square opening 88, 90. As best seen in FIG. 5, the square opening 88 of the upper hopper guide 76 is of a smaller dimension than the square opening 90 defined by the lower hopper guide 78. It will be appreciated however that other shapes for the guides 76, 78 and openings 88, 90 could be employed, such as for example, round or circular guides and openings.

Figure 8:
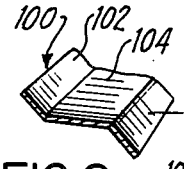
FIG. 8 is a side perspective view of one of the blades of the agitating and support means, taken along lines 8—8 of FIG. 7.
Figure 7:
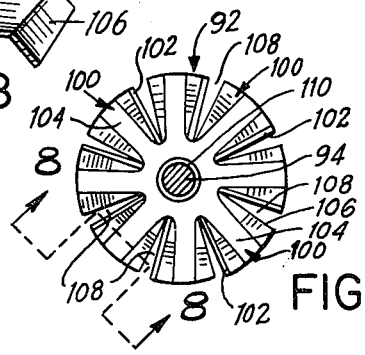
FIG. 7 is a top elevational view of the agitating and support means of the coin dispensing unit, taken along line 7—7 in FIG. 5.
Figure 11:
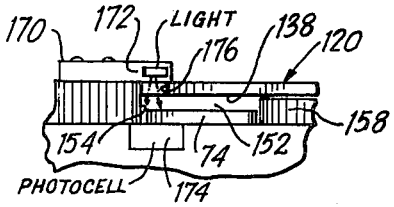
FIG. 11 is a schematic side elevational view, taken along lines 11—11 of FIG. 6, illustrating the mechanism for counting of coins as they are dispensed.

An agitator and support means 92 is also supported within the hopper 70 by means of a vertical post 94 which is generally coaxially arranged within the circular openings 88, 90 of the hopper guide members 76, 78. The post 94 is supported at its upper end by a cross bar 96 which in turn is supported by the upper ends of the side walls 72 of the hopper section 70. If desired, the elevation of the post 94 may be vertically adjusted with respect to the side walls 72 of the hopper section 70. At its lower end, the support post 94 includes an enlarged flange portion 98 which in turn supports the agitator and support means 92. In the preferred embodiment, the agitator and support means comprises a fan-like agitator and support element 92, best shown in plan view in FIG. 7, which includes a plurality of circumferentially spaced blade elements 100. As best seen in FIG. 8, each of the blade elements 100 includes an upwardly inclined portion 102, a substantially horizontally arranged portion 104, and a downwardly inclined portion 106.

The agitator and support element 92 includes an central opening 110 through which the support post 94 may extend, the opening 110 being sized to be of a smaller dimension than the flange portion 98 so that the flange portion 98 serves to support the agitator and support element 92 in a generally horizontal position, as best shown on FIG. 5. The agitator and support element 92 is freely rotatable with respect to the support post 94, and in addition is free to move upwardly off of the lower flange portion 98. Thus, it will be appreciated that the support post 94 serves to define the lower limit or position of the agitator and support element 92 with respect to the hopper section 70 and that during use the agitator and support element 92 may move vertically upward and rotate relative to the support post 94.

extending recess of the guide plate member 120. The shoulder extension 154 extends generally tangentially from a portion of circular shoulder 140 to the outer edge of the guide plate member 120. One end 166 of the guide finger 158 extends inwardly into the circular recessed area in the lower surface 138 of the guide plate member 120 and has an edge surface 164 which is generally parallel to the surface of the shoulder extension 154 so as to define with the shoulder extension 154 the lateral outlet slot 152 for coins 74. In other words, the end 166 of the guide finger 158 protrudes inwardly into the annular coin passageway 150 between the lower surface 138 of the guide plate member 120 and the upper surface 144 of the feed disc 134. Further, the guide finger 158 and shoulder extension 154 are oriented or positioned at an angle such that coins 74 moving about the circumference of the shoulder 140 upon rotation of the feed disc 134 will be intercepted by the edge surface 164 of the guide finger 158 and moved outwardly through the outlet slot 152.

In order to ensure that only the desired number of coins 74 are dispensed at any given time, there is provided a suitable coin counting mechanism 170 adjacent the outlet slot 152 for counting coins 74 as they pass therethrough. In the preferred embodiment, this counting mechanism 170 comprises a suitable light source 172 and photocell 174 which are arranged along one of the side edges of the outlet slot 152 (see FIGS. 6, 9 and 11). More particularly, the light source 172 is supported on the upper surface of the guide plate member 120 to overlie a suitable opening 176 in the guide plate member 120 which is aligned with a portion of the outlet slot 152, and the photocell 174 is arranged beneath the outlet slot 152 in alignment with the opening 176 so that the light beam from the light source 172 is normally directed onto the photocell 174. As coins 74 pass through the outlet slot 152, a portion of the peripheral edge of the coins 74 intercepts the light beam to generate a pulse which is applied to the control unit for the device 10 to maintain a running count of the coins 74 as they are dispensed or fed through the outlet slot 152.

In this regard, it is preferable that the light source 172 and photocell 174 be arranged transversely to the direction that coins 74 move through the outlet slot 152, and in particular be arranged to one side of the outlet slot 152 so as to ensure that the light beam will be interrupted by each coin 74 which passes thereby but will not be continuously interrupted when a series of coins 74 in engagement with one another pass through the outlet slot 152. In other words, if the light source 172 were centrally arranged with respect to the outlet slot 152, and if a series of coins 74 were touching one another as they pass through the outlet slot 152, the light beam might be continuously interrupted and only indicate a count of one, when in fact several coins 74 were dispensed. Such an arrangement of the light source 172 and photocell 174 as utilized in the preferred embodiment of the present invention is similar to that shown in U.S. Pat. No. 3,777,769. However, it will of course be appreciated that other types of coin counting mechanisms could be employed to count the coins 74 as they are dispensed through the outlet slot 152.

The operation of the coin dispensing device **12*a* will now be described. The hopper section 70 of the coin dispensing device 12*a* includes a suitable supply of coins 74 therein, only a small number of which are illustrated in FIGS. 4 and 5. Normally, the entire space between the upper and lower hopper guides 76, 78 is filled with coins 74 for dispensing, the coins 74 resting in a vertical random array between the hopper guides 76, 78 with the lowermost coins 74 actually resting on a portion of the feed disc 134 and guide plate member 120. When it is desired to dispense coins 74, the feed disc 134 is rotated by suitable means, such as for example, a motor 178 and drive connection 180 provided between the shaft of the motor 178 and the feed disc 134. Upon rotation of the feed disc 134, the lowermost coins 74 in the hopper section 70 will be guided into the annular space 146 between the edge surface 128 of the guide plate member 120 and the outer circumferential surface 148 of the hub element 142 on the feed disc 134 so that the coins 74 drop onto the feed disc 134. As the feed disc 134 is rotated, because of the centrifugal force created on the coins 74, the coins 74 on the feed disc 134 will be directed radially outward beneath the lower edge 132 of the guide plate member 120 to pass into the annular coin in passageway 150, the outward movement thereof being limited by the downwardly depending circular shoulder 140 on the lower surface 138 of the guide plate member 120**.

As the coins 74 are moved about the circular shoulder 140 by rotation of the feed disc 134, they will subsequently approach the lateral outlet slot 152 and engage the protruding guide finger 158 which will serve to direct the coins 74 into the outlet slot 152. Because of the momentum of the coins 74 imparted by the feed disc 134, as well as the fact that the edge 136 of the feed disc 134 extends slightly into the outlet slot 152, the coins 74 will be urged outwardly through the outlet slot 152 and the opening 182 in the side of the dispensing device **12*a* and from there simply fall into the payout hopper 26*a* located beneath and forwardly of the dispensing device 12*a*. As each coin 74 passes through the outlet slot 152, it will intercept the light beam of the coin counting mechanism 170 to appropriately index the counting mechanism 170**.

Guiding of coins 74 onto the feed disc 134 is aided by the agitator and support element 92. More particularly, the agitator and support element 92 serves to support those coins 74 in the hopper section 70 which are above the agitator and support element 92 so that the weight of the coins 74 does not substantially interfere or hinder rotation of the feed disc 134. Further, as the feed disc 134 is rotated, coins 74 which are partially in engagement with the feed disc 134 will be agitated and moved in the lower portion of the hopper section 70. This action in turn causes the movement of the agitator element 92 to rotate to further agitate and move coins 74 in the hopper section 70. During this agitation of the coins 74, the blades 100 on the agitator element 92 will serve to direct coins onto the feed disc 134 and further supports excess coins 74 not yet needed. In this regard, it will be appreciated that the coins 74 passing downwardly past the agitator element 92 will be guided so as to be oriented and in a position so as not to be on edge, but rather so that they will fall "flat" onto the feed disc 134. In other words, since the coins 74 are inclined with respect to the vertical after passing the agitator element 92, they will tend to topple and fall flat, or at best be arranged so as to be oriented generally horizontal after the coins therebeneath are dispensed radially outward beneath the guide plate member 120. This is advantageous in order to orient the coins so as to be in position to fall horizontally into the annular space 146 between the edge surface 128 of the guide plate member 120 and the circumferential surface 148 of the central hub ele- The coin dispensing unit 12*a* also includes a lower base section 112 on which the hopper section 70 is supported. The base section 112 comprises a generally box-shaped housing defined by side walls 114 and front and rear walls 116, 118. In the preferred embodiment, the forward edge of the side walls 114 is recessed slightly, as best seen in FIG. 4, so that the front wall 116 of the base section 112 is recessed slightly at its lower end. This is desirable in order to provide an enlarged opening into the associated payout hopper 26*a* (not shown in FIG. 4) which is located immediately below the coin dispensing unit 12*a*. The base section 112 includes at its upper end a guide plate member 120 which is supported by means of blocks 122 affixed to the side, front and rear walls 114, 116, 118 of the base section 12, as best seen in FIGS. 4, 5 and 6. The hopper section 70 in turn is supported on the guide plate member 120 by means of brackets 124, the dimensions of the side walls 72 of the hopper section 70 corresponding generally and being aligned with the outer periphery of the guide plate member 120.

As best seen in FIGS. 4, 5, 6 and 10, the guide plate member 120 includes a centrally located circular opening 126 therethrough defined by a circular downwardly tapered or inclined edge surface 128. When the hopper section 70 is assembled onto the base section 112 of the coin dispensing unit 12*a*, the lower edge 86 of a lower hopper guide 78 is sitting directly on the guide plate member 120, and terminates adjacent the upper edge 130 of the inclined edge surface 128 of the guide plate member 120, as best seen in FIG. 5 and FIG. 10, so that coins exiting from the hopper section 70 are directed toward the central opening 126 of the guide plated member 120.

The coin dispensing device 12*a* also includes a rotatable horizontally arranged feed disc 134 which is positioned vertically beneath the guide plate member 120 of the dispensing device 12*a*. The feed disc 134 is suitably mounted for rotation about an axis which substantially coincides with the axis of the circular opening 126 in the guide plate member 120. The feed disc 134 is generally circular and has a diameter which is greater than the diameter at the opening 126 through the guide plate member 120 so that the peripheral edge 136 of the feed disc 134 lies beneath the lower surface of the guide plate member 120, as best seen in FIGS. 5 and 10. In this regard, the guide plate member 120 preferably is machined or constructed so that its lower surface 138 has a circular recessed portion defined by a downwardly projecting shoulder 140, the recessed portion being of a slightly greater diameter than the diameter of a feed disc 134, (see FIG. 10).

The feed disc 134 also includes a centrally arranged, upwardly projecting circular hub element 142 which is coaxially arranged with respect to the axis of rotation of the feed disc 134. The diameter of the central hub element 142 is less than the diameter of the circular opening 126 through the guide plate member 120 by an amount which is approximately equal to or slightly more than twice the width of the coins 74 to be dispensed therefrom. More particularly, the central hub element 142 projects upwardly from the upper surface 144 of the feed disc 134 and defines, with the lower edge 132 of the tapered edge surface 128 of the guide plate member 120, an annular space or passage 146 between the edge surface 128 of the guide plate member 120 and the circumferential edge surface 148 of the hub element 142. The width of the annular space 146 is approximately equal or slightly greater then the width of the coins 74 to be dispensed so that the coins 74 may be guided from the hopper section 70 onto the upper surface 144 of the feed disc 134 through the annular space 146, i.e., through the circular opening 126 of the guide plate member 120 about the circumference of the central hub element 142. In other words, the coins 74 in being guided through the guide plate member 120 are confined to pass through the annular space 146 between the circumferential edge surface 148 of the hub element 142 and the edge surface 128 of the guide plate member 120.

The upper surface 144 of the feed disc 134 is vertically spaced from the lower surface 138 of the recessed portion of the guide plate member 120 by an amount which is greater than the thickness of the coins 74 to be dispensed, but which is less than twice the thickness of such coins 74. In this manner, an annular passageway 150 is defined between the lower surface 138 of the guide plate member 120 and the upper surface 144 of the feed disc 134 for the passage of coins 74 radially outward beneath the lower edge 132 of the edge surface 128 of the guide plate member 120. Movement of coins 74 into this annular passageway 150 is accomplished by rapid rotation of the feed disc 134 relative to the guide plate member 120 which creates a centrifugal force on the coins 74 to move same radially outward. More particularly, as the feed disc 134 is rotated, coins 74 which are fed or distributed onto the feed disc 134 through the annular space 146 defined between the central hub 142 and the edge surface 128 of the guide plate member 120 will be urged radially outward along the surface 144 of the feed disc 134 beneath the lower edge 132 of the surface 128 of the guide plate member 120 into the annular coin passageway 150 as a result of the centrifugal force created on the coins 74. The downwardly depending shoulder 140 provided on the lower surface 138 of the guide plate member 120 serves as a suitable stop for this radial outward movement of the coins 74. The coins 74 will then simply move about the circumference of the shoulder 140 as the feed disc continues to rotate. In this regard, since the height of the coin passageway 150 (i.e., the spacing between the upper surface 144 of the feed disc 134 and the lower surface 138 of the guide plate member 120) is less than twice the thickness of the coins 74, the coins 74 in the passageway 150 will not be stacked on top of one another but rather will be arranged in a side-by-side relationship in a single plane.

Preferably, the upper surface of the feed disc is made of a suitable material so as to provide a relatively high friction surface for ensuring that rotational momentum is imparted to the coins 74 upon rotation of the feed disc 134. For example, the feed disc 134 could be constructed of a neoprene rubber material, or the upper surface could be coated with a neoprene rubber material, or alternatively, a high friction circular mat could be secured to the upper surface of the feed disc 134.

The lower surface 138 of the guide plate member 120 is also provided with a laterally extending recess or passageway, as best seen in FIG. 9. A guide finger or block 158 is adjustably mounted in this lateral recess so as to define with the shoulder extension 154 a coin outlet slot 154 through which coins 74 may exit from the coin passageway 150 (see FIGS. 6 and 9). More particularly, the plate 120 has a pair of slots 160 therethrough for receipt of fastening means, such as screws and nut plate 162, to secure the guide finger 158 in the laterally ment 142. It should also be noted that the edge surface 128 of the guide plate member 120 is tapered or inclined about the circular opening 126 therethrough. This is advantageous for also orienting the coins 74 into a position to fall or be placed horizontally in the annular space 146 provided between the hub 142 and move downwardly along the lower plate portion 82 of the lower hopper guide 76 and the edge surface 178 and the lower edge 132 of the guide plate member 120 as the coins 74, thereby aiding in proper placement of the coins 74 onto the feed disc 134.

As soon as each coin 74 is aligned with the annular space 146 between the edge surface 128 of the guide plate member 120 and the circular hub 142, it will drop onto the feed disc 134 and pass radially outward beneath the lower edge 132 of the edge surface 128 of the guide plate member 120 as the feed disc 134 rotates. It is important that the spacing between the circumferential surface 148 of the hub element 142 and the edge surface 128 of the guide plate member 120 be chosen to approximate the lateral dimension or width of the coins 74 so that only one coin 74 will be fed onto the feed disc 134 at any particuar circumferential location. If more than one coin or portions thereof could engage the upper surface 144 of the feed disc 134, such as for example, when one coin lies flat against the edge of the hub 142 and additional coins are inclined or stacked thereon so that the outermost coin is inclined, coins 74 could jam in the entrance to the annular passageway 150 between the guide plate member 120 and the feed disc 134. In this regard, it will be appreciated that if a plurality of coins were stacked in the annular space 146 with the outermost coin inclined with respect to the entrance to the annular space 150, because of the centrifugal force created by rotation of the feed disc 134, the radially innermost coin would be forced radially outward and cause the radially outermost coin to jam at the lower edge 132 of edge surface 128 of the guide plate member 120. Such a jam condition is not possible with the present invention since the annular spacing 146 between the edge surface 128 of the guide plate member 120 and the circumference surface 148 of the hub element 142 substantially corresponds to the width of the coins 74 to be dispensed. Even if coins 74 are stacked on top of one another, the lowermost coin 74 would still be free to pass beneath the lower edge 132 of the edge surface 128 of the guide plate member 120.

The speed of dispensing of coins 74 is also aided by the fact that the upper surface 144 of the feed disc 134 and the hub element 142 are of a material having a relatively high coefficient of friction, such as provided by neoprene rubber. This will also reduce the wear on the coins 74. Such a material aids in gripping of the coins 74 so that the coins 74 do not easily slip and slide relative to the feed disc 134 during rotation. In this regard, it has been found that use of a suitable high friction type surface for the feed disc 134 serves to increase the number of coins 74 which may be dispensed upon rotation of the feed disc 134. For instance, in the preferred embodiment, the feed disc 134 is rotated at approximately 250 revolutions per minute and serves to feed coins through the outlet slot 152 at the rate of approximately 2,000 per minute or approximately 25–35 coins per second. If a metallic, or smooth low friction surface were provided for the feed disc 134, approximately 500 revolutions per minute would be required to dispense only approximately 800 coins per minute. It is believed that the increased rate of dispensing when a high friction surface 144 is utilized results from the fact that the coins 74 are in essence "gripped" by the upper surface 144, and spun or fed radially outward, whereas, if a low coefficient or friction surface were provided, upon rapid rotation of the feed disc 134, the coins 74 would simply slip relative to the surface of the feed disc 134 and not be fed radially outward.

It will further be appreciated that an increased rate of feeding of coins 74 with the present invention is accomplished by virtue of the fact that a plurality of coins 74 may be provided at any one instant in the annular space 146 on the feed disc 134 between the hub element 142 and the edge surface 128 of the guide place member 120, as illustrated in FIG. 6. Thus, a plurality of coins 74 may be fed onto the disc 134 at one time, such that a plurality of coins 74 will be urged radially outward beneath the lower surface 138 of the guide plate member 120 to then be dispensed through the outlet slot 152. As noted above, when the feed disc 134 is rotated at approximately 250 rpm, approximately 25–35 coins will be dispensed per second with the dispensing device 12*a* in accordance with the present invention. Thus, 200 coins can be dispensed in approximately 7.2 seconds, which is at a greatly increased rate in comparison to conventional present day coin dispensing units which so far as known to applicant, are only capable of dispensing approximately 200 coins in 30 seconds.

After the appropriate or desired number of coins 74 have been dispensed through the outlet slot 152 (as determined by the coin counting mechanism 170), the control unit for the device 10 generates a signal to rapidly cease rotation of the feed disc 134, and in the preferred embodiment to reverse rotation of the feed disc 134 slightly to aid in preventing jamming and prevent an inadvertent payout. In order to ensure that the coins 74 are not dispensed during arresting of rotation of the feed disc 134, a pin member 186 is provided adjacent the side of the outlet slot 152. The pin member 186 is adapted to be moved into the outlet slot 152 and prevent further coins 74 from being dispensed outwardly therethrough. More particularly, one end of the pin member 186 is vertically arranged to extend a suitable slot 188 in the guide plate member 120, as best shown in FIGS. 5 and 6. The other end of the pin element 186 is suitably secured to a transversely or laterally movable block element 190. The block element 190 in turn is connected to the armatures 192 of a pair of solenoids 194 mounted on opposite sides of the dispensing unit 12*a* and aligned parallel to the longitudinal direction of the slot 188 in the guide plate member 120 so that the pin element 186 may be moved between a retracted position (shown in full outline in FIG. 12) and a blocking position (shown in dotted outline in FIG. 12).

Normally, the pin element 188 is positioned in its retracted position. When an appropriate number of coins 74 have been dispensed, a signal is generated by the control unit for the device 10 to shift the block element 190 to the right as viewed in FIG. 5 to move the pin element 186 into blocking relationship with respect to the outlet slot 152. The pin element 186 thus serves to prevent any further coins from being dispensed through the outlet slot 152; instead, the coins 74 remain on the feed disc 134 in position to be dispensed subsequently. In this regard, it should be noted that the end 166 of the guide finger 158 extends sufficiently inward so that one coin 74*a* is held in the entrance to the outlet slot 152 by the pin member 186. Also, it will be appreciated that since the coins 74 in the annular coin passageway 150 are no longer dispensed through the outlet slot 152, no further coins 74 in the hopper section 70 will be able to be fed onto the feed disc 134.

In the preferred embodiment, the central hub element 142 is interchangeable so as to provide different size hub elements 142 to thereby accommodate different sizes or denominations of coins 74 to be dispensed. Additionally, the guide finger 158 can be adjusted with respect to the guide plate member 120 so as to vary the width of the spacing of the lateral outlet slot 152 through which the coins 74 exit from the dispensing unit 12*a*. Thus, in order to adapt the coin dispensing device 12*a* to dispense different size coins 74, it is only necessary to make three minor adjustments—namely, change the hub element 142, adjust the position of the guide finger 158, and adjust the height of the feed disc 134 relative to the lower surface 138 of the guide plate member 120 (i.e., to make the height of the space 150 less than twice the thickness of the coins to be dispensed). In this regard, the feed disc 134 preferably includes a central raised pin 198 of a small diameter over which a neoprene disc or annular ring 142*a*, of an appropriate size corresponding to the appropriate denomination of the coins to be dispensed, is forced to provide the raised central hub element 142 of the device 12*a*. Accordingly, changing the size of the hub element 142 can be easily accomplished by lifting of the disc or ring 142*a* from the pin 198 and replacing it with a new different size disc 142*a*.

Figure 12:
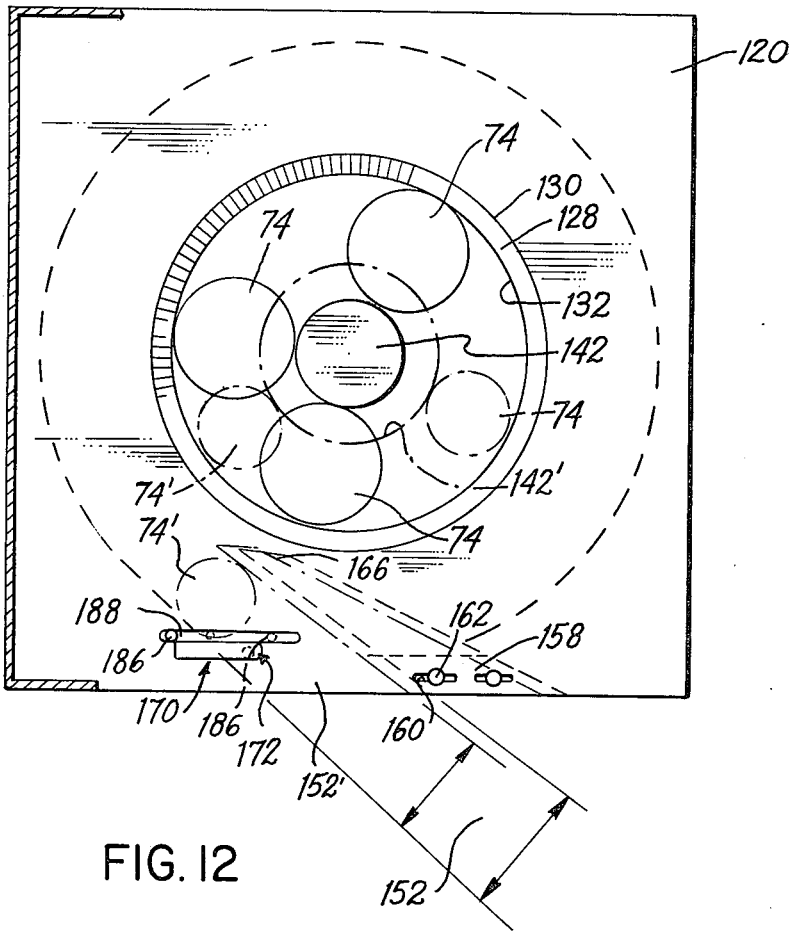
FIG. 12 is a top sectional view, similar to FIG. 6, illustrating the adjustments which are necessary for accommodating different denominations of coins to be dispensed by the dispensing unit.

FIG. 12 illustrates the nature of the changes for accommodating different size coins 74 and 74'. More particularly, as illustrated in solid outline, a relatively small central hub element 142 is provided on the feed disc to provide a relatively large annular space 146 between the edge surface 128 of the guide plate member 120 and the circumferential surface 148 of the central hub element 142 for accommodating relatively large size coins 74, such as for example, quarters. Similarly, the guide finger 158 is displaced and positioned to the right as shown in FIG. 12 for providing a relatively large width for the outlet slot 152. If a smaller size coin 74' is to be dispensed from the dispensing device 12*a*, such as for example a dime, a different hub element 142', illustrated by the dot-dash line of FIG. 12, is provided which defines a narrower width for the annular space 146 between the hub element 142' and the edge surface 128 of the guide plate member 120, which spacing corresponds to the width of the desired coin 74', i.e., a dime. Similarly, the guide finger 158 is moved in the left hand direction as viewed in FIG. 12 to provide a more narrow width for the outlet slot 152', corresponding to the width of the coin 74', i.e., corresponding to the width of the dime in the example given. Also, the feed disc 134 is repositioned in a suitable manner relative to the lower surface 138 of the guide plate member 120 so that the height of the space or passageway 150 is less than twice the thickness of the desired coin 74', i.e., less than twice the thickness of a dime.

In this regard, although the rate at which coins 74 are dispensed from the coin dispensing unit 12*a* is dependent on the size of the coin 74, generally for nickels, dimes, quarters and half-dollars, coins may be dispensed at a rate of approximately 25–35 coins per second, which rate is significantly greater than the rate at which coins are dispensed with prior art, conventional dispensing devices.

As noted above, as the coins 74 exit through the outlet slot 152, they simply are directed away from the dispensing device 12*a* and fall into the corresponding payout hopper 26 located therebeneath. In this regard, a suitable deflecting plate or member may be provided adjacent the lateral outlet slot 152 which, when struck by the coin 74 being dispensed from the outlet slot 152, simply directs the coin into the payout hopper 26*a* located therebeneath. Such a deflecting member could comprise the front cover 22 of the gaming device 10 or, if desired, a different deflecting member could be provided.

It should further be noted that in accordance with the preferred embodiment in which the hopper section 70 is arranged vertically, the outer dimension of the coin dispensing unit may be minimized such that it will require or take up less space in the gaming device 10. This is important in minimizing the overall depth of the gaming device 10 which in turn permits the placement of more gaming devices in a casino or gaming house in a given area. For instance, in the preferred embodiment, the depth of the gaming device 10 may be on the order of 10–11 inches, whereas conventional gaming devices have a depth on the order of 16–18 inches.

The gaming device 10 in accordance with the present invention also includes a coin accepting mechanism 34, shown schematically in FIG. 2, which serves to detect which denomination of coins have been deposited into the device 10, as well as the number of each denomination of coins which have been inserted. Coin acceptors 34 for accomplishing these purposes are well known in the art, and any suitable conventional multi-denomination coin acceptor could be utilized.

When a coin is deposited in the coin slot 32 of the machine 10, it first turns the machine 10 on. The coin is then directed into an appropriate chute or slot (not shown) in the coin acceptor 34 corresponding to the denomination of the coin, and subsequently activates a corresponding switch 222*a*, 222*b*, or 222*c* arranged therein or therebelow. Activation of the corresponding switches 222*a*, 222*b*, and 222*c* in turn generates pulses to increment corresponding coin-in registers of the control unit for the device 10. The state of each of the coin-in registers correspond to the number of coins of the corresponding denomination which have been inserted.

Figure 14:
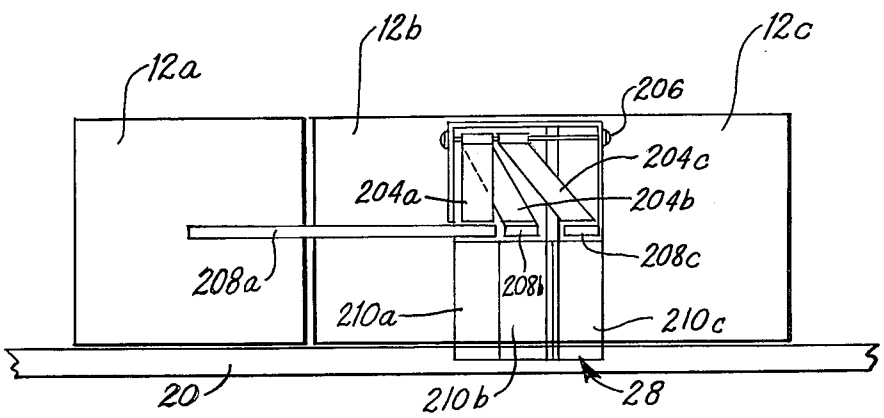
FIG. 14 is the top elevational view of the coin diverting mechanism taken along lines 14—14 of FIG. 13.
Figure 13:
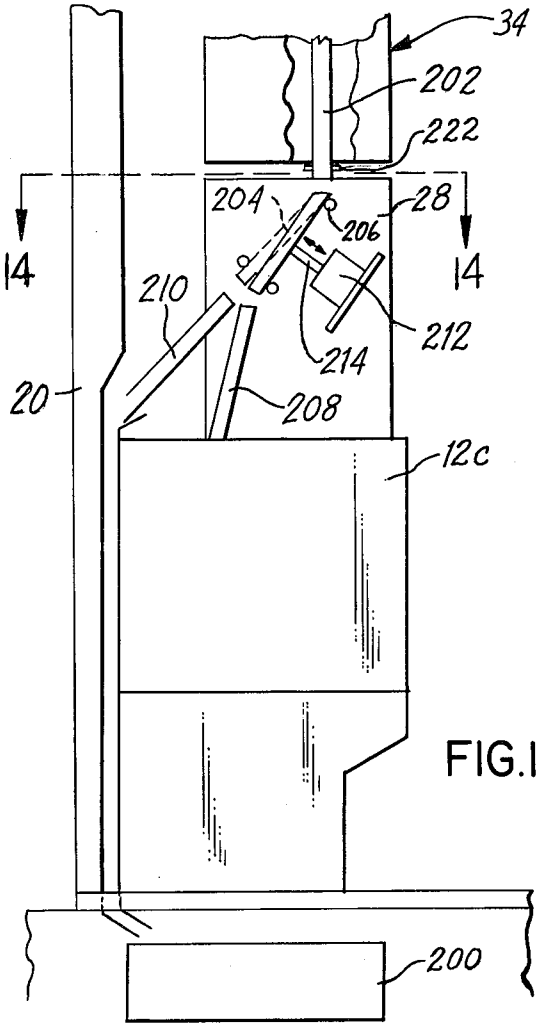
FIG. 13 is a side elevational view of the coin diverting mechanism of the gaming device, taken along lines 13—13 in FIG. 2, illustrating how coins are diverted to the hopper sections of the dispensing units and to the gaming device hold.

After passing by the corresponding switches 222*a*, 222*b* or 222*c*, the coins are directed to a coin diverter unit 28 for diverting the coins which are deposited by the players into either the appropriate hopper section 70 of the dispensing units 12*a*, 12*b*, 12*c*, or, if the corresponding dispensing units 12*a*, 12*b*, 12*c* already contain a suitable supply of coins, into a hold or take receptacle 200 located in a stand under the gaming device 10. In this regard, the coin diverting mechanism 28 in accordance with the preferred embodiment is illustrated in FIGS. 13 and 14 of the drawings. The coin diverter mechanism 28 is located directly beneath the coin acceptor mechanism 34, and receives coins deposited by players to activate the machine for a particular play.

After the denominations and number of coins have been detected by the switches 222*a*, 222*b*, 222*c* between the coin acceptor mechanism 34, the coins are directed downwardly in their respective chutes 202*a*, 202*b*, 202*c* (shown schematically in FIG. 2) to the coin diverter mechanism 28. In the preferred embodiment, three separate passageways or chutes 202*a*, 202*b*, 202*c* are provided for the coins between the coin acceptor 34 and the coin diverter 28, one for each of the different denominations of coins which are intended to be used with the gaming device 10. The coin diverter mechanism 28 at its lower end includes a plurality of coin chutes or slides 204*a*, 204*b*, 204*c* which are aligned with the chutes or slides 202*a*, 202*b*, 202*c* from the coin acceptor 34. In the preferred embodiment wherein three different denominations of coins are to be utilized, three chutes 204*a*, 204*b*, 204*c* are provided in the coin diverter 28 which are arranged in side-by-side relationship, one for each of the different denominations of coins. The upper or inlet ends of the chutes 204*a*, 204*b*, 204*c* are each aligned with the corresponding chutes 202*a*, 202*b*, 202*c* of the coin acceptor mechanism 34 for the different denominations of coins. The coin diverter chutes 204*a*, 204*b*, 204*c* are each pivotably mounted about a suitable horizontally extending shaft 206 so as to be pivotable beween a first or lower position, shown in solid outline in FIG. 13, and a second or upper position, shown in dotted outline in FIG. 13.

When the coin diverter chutes 204*a*, 204*b*, 204*c* are in their lower positions, the outlet in lower ends of the chutes 204*a*, 204*b*, 204*c* are aligned with a further set of chutes 208*a*, 208*b*, 208*c* for directing the coins to the hopper sections 70 of the appropriate coin dispensing units 12*a*, 12*b*, 12*c*, as can best be seen in FIG. 14. In this position, the coins from the coin acceptor 34 are received in the appropriate chutes 204*a*, 204*b*, or 204*c* of the the coin diverter 28 and slide downwardly into the corresponding hopper chutes 208*a*, 208*b*, 208*c* where the coins then slide by gravity into the upper end of the corresponding hopper section 70 of the coin dispensing units 12*a*, 12*b*, 12*c*. Each of the hopper chutes 208*a*, 208*b*, 208*c* is aligned at one end with the outlet end of its corresponding coin diverter chute 204*a*, 204*b*, 204*c* and at its other end with the open upper end of the hopper section 70 of the corresponding coin dispensing unit 12*a*, 12*b*, or 12*c*.

When the lower or outlet ends of the coin diverter chutes 204*a*, 204*b*, 204*c* are in their raised position, the outlet ends are arranged closely adjacent to a set of take chutes or slides 210*a*, 210*b*, and 210*c* having their inlet ends supported from the coin diverter unit 28 directly above the inlet ends of the hopper chutes or slides 208*a*, 208*b*, 208*c*. The outlet ends of the chutes or slides 210*a*, 210*b*, 210*c* are arranged directly above a suitable hold receptacle 200 arranged in the stand for the gaming device 10. It will of course be appreciated that although only one hold receptacle 200 has been illustrated in FIGS. 13 and 14, a plurality of such hold receptacles, one for each of the different denominations of coins, could be utilized.

Movement of the coin diverter chutes or slides 204*a*, 204*b*, 204*c* between the lower and raised positions is accomplished through the use of suitable solenoid members 212 and/or mechanical flip flop, one for each of the chutes 204*a*, 204*b*, 204*c* and each, having a ram 214 which is joined to the lower surfaces of its respective coin diverter chute 204*a*, 204*b*, 204*c* adjacent the outlet end thereof (for clarity, only one solenoid 212 and ram 214 are shown in FIG. 13). Retraction of the rams 214 of each solenoid 212, serves to position the respective coin diverter chutes 204*a*, 204*b*, 204*c* in their lower positions, whereas extension of the rams 214 serves to move the ends of the respective coin diverter chutes 204*a*, 204*b*, 204*c* to their raised positions. In this regard, each of the three coin diverter chutes 204*a*, 204*b*, 204*c* is independently movable between the lower and raised positions so that the outlet ends of the coin diverter chutes 204*a*, 204*b*, 204*c* may be independently aligned either with the corresponding hopper chutes 208*a*, 208*b*, 208*c* or the corresponding hold chutes 210*a*, 210*b*, 210*c*. That is, each of the coin diverter chutes 204*a*, 204*b*, 204*c* is independently pivotable about the horizontal support shaft 206, and each of the solenoids 212*a*, 212*b*, 212*c* is independently actuatable. Accordingly, one of the coin diverter chutes, e.g., 204*a*, could be arranged to be aligned with its corresponding hopper chute 208*a* for dispensing the coins into the hopper section 70 of the corresponding dispensing unit 12*a*, while another of the coin diverter chutes, e.g. 204*b*, could be aligned with its corresponding hold chute 210*b* for directing coins to the hold or take receptacle 200. This arrangement is most advantageous for controlling where deposited coins are to be directed.

In this regard, as is generally known with respect to gaming devices having only one coin dispensing unit, the hopper section of the coin dispensing unit of the gaming device must be initially charged with a certain quantity of coins for dispensing whenever a payout or win condition is generated. Thus, generally at the beginning of each day, the owner or renter of the gaming device will check the coin dispensing hopper to ensure that it is initially charged with an appropriate quantity of coins. If it is not, the hopper is then recharged. This type of operation must also be performed with each of the coin dispensing units 12*a*, 12*b*, 12*c* of the gaming device 10 in accordance with the present invention. During the play of the device 10 over the course of the day, coins deposited by players will either be directed to the appropriate hopper sections 70 of the coin dispensing units 12*a*, 12*b*, 12*c* if the quantity of coins therein is below and the initial charged state, or to the take or hold receptacle 200 when the appropriate hopper sections 70 have the required number of coins therein. In other words, during operation of the gaming device 10, coins will be dispensed from the respective dispensing units 12*a*, 12*b* and 12*c*, which will thus deplete the quantity of coins therein, if a particular hopper section 70 has less than the predetermined quantity of coins therein, upon the next subsequent play, the coins of the same denomination will be initially directed to the hopper section 70 of the appropriate coin dispensing unit 12*a*, 12*b*, or 12*c* by control of the corresponding solenoid 212 until a sufficient number of coins has been deposited into the corresponding hopper section 70 to bring the quantity of coins up to the initial charged state. Thereafter, the corresponding solenoid 212 will be actuated to raise the corresponding coin diverter chute 204*a*, 204*b*, or 204*c* to its raised position, and any subsequent coins of the same denomination will be directed to the hold receptacle 200. When coins are dispensed from the respective hopper section 70, thereby depleting the quantity of coins therein, the corresponding solenoid 212 will be deactivated to retract the associated ram 214 to move the corresponding coin diverter chute 204*a*, 204*b*, or 204*c* to its lower position, and subsequent coins of the same denomination will be directed into the respective hopper section 70. The coin diverter solenoids 212 may be appropriately controlled by maintaining a count of the number of coins payed out of the respective hopper sections 70 and of the number of coins subsequently deposited thereinto so that number of coins in each of the hopper sections 70 of the coin dispensing units 12*a*, 12*b*, 12*c* is maintained at the initial predetermined level.

Figure 15A:
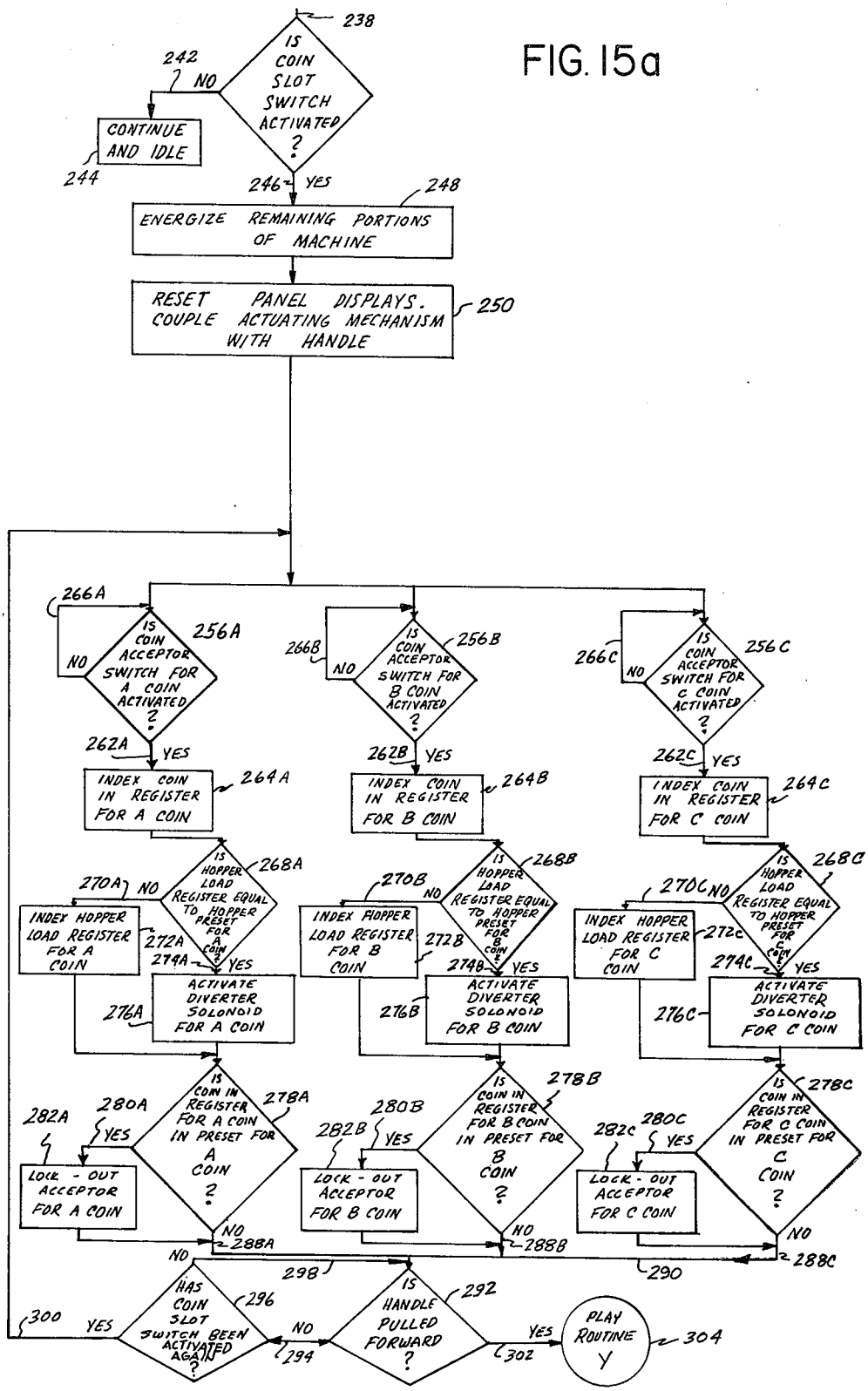
FIGS. 15*a* and 15*b* are schematic flow charts illustrating the algorithm for controlling operation of the gaming device in accordance with the present invention.
Figure 15B:
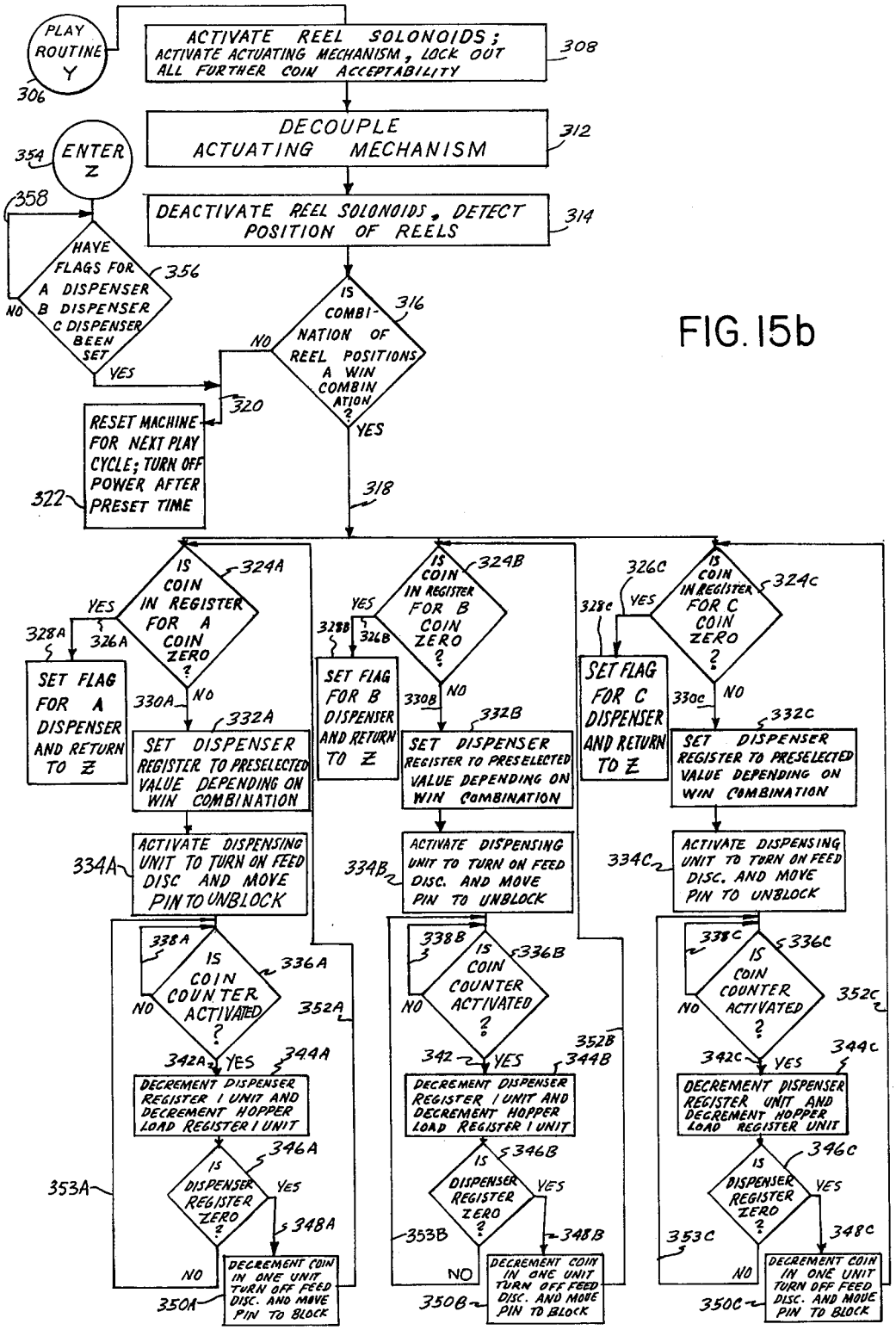

The operation of the gaming device 10 in accordance with the present invention will now be described with reference to FIGS. 15*a* and 15*b* which illustrate schematically the basic functions of the gaming device 10. In this regard, the control of the gaming device 10 may be accomplished with the use of a microprocessor unit which has connected thereto an erasable programmable memory (EPROM) which stores fixed information, such as the control program, and a random access memory (RAM) for receiving changeable information such as the changed state of registers and/or for making comparisons and calculations. More particularly, the microprocessor unit for controlling operation of the gaming device 10, in accordance with the preferred embodiment of the present invention, is connected to the coin slot switch 220, the coin acceptor mechanism 34 (including the coin acceptor switch 222*a*, 222*b* and 222*c*), the coin diverter mechanism 28, the actuator mechanism 40 (including the handle movement switch or sensor 25), the reel stopping means (discs 44 and engaging means 50), the reel detector means 66 for detecting the position of the reels 14 after their rotation has been arrested, and the coin dispensing units 12*a*, 12*b*, and 12*c* (including the coin counting mechanisms 170 thereof). Additionally, the microprocessor unit is programmed (in the EPROM) to perform in accordance with the hereinafter described manner as illustrated in the flow charts of FIGS. 15*a* and 15*b*. That is, the flow charts of FIGS. 15*a* and 15*b* illustrate the implementation of the basic algorithm for the microprocessor unit for controlling operation of the gaming device 10. It will of course be appreciated, however, that control of the various functions in accordance with the flow charts of FIGS. 15*a* and 15*b* could also be accomplished with suitable electronic circuitry in accordance with well known principles.

Prior to the use of the gaming device 10, the majority of the electronic and electrical components are deenergized so as to not to needlessly waste electricity, the device 10 generally being in a idle state. The device 10 will then be turned on by simply depositing a coin into the coin slot 32. More particularly, referring to FIG. 15*a*, the program of the device 10 is entered along line 238 and initially tests whether a coin has been deposited into the coin slot 32, as indicated by the diamond 240. This can be accomplished by testing whether the coin slot switch 220 has been tripped. If no coin has been deposited, the device 10 continues to await insertion of a coin, and remains idle, as indicated by the arrow 242 and rectangle 244. When a coin is deposited into the coin slot 32, it will be directed downwardly, such as by gravity, to move past the coin slot switch 220 to thereby trip same. For example, the coin slot switch 220 may comprise a light source-photocell combination which is tripped when a coin moves therepast.

When the coin slot switch 220 is tripped (i.e., the test of the diamond 240 is affirmative), the remaining portion of the electronic and electrical components of the device 10 will be energized in order to ready the device 10 for performing the remaining operations during a play cycle of the device 10, as indicated by the arrow 246 and rectangle 248 in FIG. 15*a*. This operation simply involves turning the power on to the remaining portion of the machine, i.e., those portions of the device 10 other than what is required for testing whether the coin slot switch 220 has been activated or tripped. At the same time, the device 10 could activate a suitable anti-yoyo mechanism for inhibiting a free play of the device 10. After the power to the gaming device 10 has been turned on, the panel displays on the front of the gaming device 10 are reset, as indicated by the rectangle 250. This operation simply involves resetting whatever displays may be provided on the machine 10, such as for indicating the denomination of the coins which have been deposited, the numbes of each denomination of coins deposited, any play sequence which may be chosen, etc. In addition, tripping of the coin slot switch 220 also serves to enable the coupling of the reel actuating mechanism 40 with the handle 24, also indicated by the rectangle 250. This operation simply involves the release of the suitable locking mechanism or device which prevents coupling of the actuator mechanism 40 with the handle 24. In this regard, it will be recalled that the handle 24 is normally free running, and is only to be coupled to the reel actuating mechanism 40 to effect a play cycle after at least one coin has been deposited in the coin slot 32.

Next, the gaming device 10 proceeds to test the denomination of the coin which has been inserted. More particularly, referring to FIGS. 2 and 13, when the first coin is deposited into the gaming device 10, the coin passes downwardly past the coin slot switch 220 and falls into the coin acceptor mechanism 34. The coin acceptor mechanism 34 then directs the coin to an appropriate chute therein (not shown) according to the denomination of the coin which has been received. In this regard, the coin acceptor mechanism 34 may be of either the electrical type, the mechanical type, or a combined electrical mechanical type for suitably directing coins received thereby into appropriate chutes or passageways corresponding to the denomination of the coin inserted. After being directed to its appropriate chute, the inserted or deposited coin falls downwardly by gravity toward the coin diverter mechanism 28. Suitable coin acceptor switches 222*a*, 222*b*, 222*c* are provided for each of the different denominations of coins which are intended to be used. For instance, a first coin acceptor switch 222*a* may be provided in association with the quarter chute of the coin acceptor mechanism 34, a second coin acceptor switch 222*b* may be provided in association with the dime chute of the coin acceptor mechanism 34, and a third coin acceptor switch 222*c* provided in association with the nickel chute of the coin acceptor mechanism 34. Although illustrated in FIGS. 2 and 13 as being interposed between the coin acceptor mechanism 34 and the coin diverter mechanism 28, the switches 222*a*, 222*b*, and 222*c* could be provided in the coin acceptor mechanism 34 at the lower end thereof, or in the coin diverter mechanism 28 at the upper end thereof. In the preferred embodiment, each of the coin acceptor switches 222*a*, 222*b*, 222*c* may suitably comprise a separate light source/photocell combination.

The tripping of one of the coin acceptor switches 222*a*, 222*b*, 222*c*, serves to generate a pulse indicating the denomination of the coin received (depending on which switch 222*a*, 222*b*, 222*c* is tripped). This pulse is detected by the microprocessor unit which then serves to index a corresponding coin-in register. In this regard, in accordance with the present invention, the gaming device 10 is adapted to receive coins of different denominations, and to receive one or more coins of each such denomination. In the preferred embodiment, three different coin denominations may be accommodated. Thus, three separate coin-in registers, one for each of the different denominations of coins, are necessary in order to maintain a running count of the denomination of coins initially deposited into the gaming device 10, and a count of the number of coins of each denomination which have been deposited.

In terms of the flow chart shown in FIG. 15*a*, after a coin has been inserted, and the power is turned on, the panel displays are reset and the actuating mechanism 40 coupled to the handle 24, the gaming device 10 tests whether any of the coin acceptor switches 222*a*, 222*b*, 222*c* for the different denominations of coins have been tripped or activated. This is indicated in FIG. 15*a* by diamonds 256*a*, 258*b* and 256*c* which represent tests of the coin acceptor switches 222*a*, 222*b*, 222*c*, respectively. For convenience, the different denominations of coins are referred to as coin A, coin B and coin C. These tests indicated by the diamonds 256A, 256B, and 256C are performed for each of the different denominations of coins and involve a test of whether or not such coin acceptor switches 222*a*, 222*b*, and 222*c* have been tripped or activated.

As the test for each of the different coin acceptor switches 222*a*, 222*b*, and 222*c* is the same for each of the different denominations of coins, only one test and the associated operations therefor, will be described in detail hereinbelow. More particularly, as noted above, the test of the coin acceptor switch for A denomination coins being activated is indicated by the diamond 256A. If this test of the coin acceptor switch 222*a* is affirmative, indicating than an A denomination coin has been deposited, the corresponding coin-in register for the A denomination coin is indexed one unit, as indicated by the arrow 262A and rectangle 264A. If the test of the coin acceptor switch being tripped for the A coin is negative, the test indicated by the diamond 256A of whether the coin acceptor switch 222*a* is tripped is continuously repeated, as indicated by the line 266A.

If an A denomination has been deposited, and the coin-in register for the A denomination coin has been indexed one unit, the machine then proceeds to test whether the hopper load register is equal to a hopper preset for the A denomination coin. In this regard, the hopper load register represents a count of the number of coins of the A denomination which are in the hopper section 70 of the corresponding dispensing unit 12*a*, whereas the hopper preset represents the number of coins of the A denomination which are to be maintained in the hopper section of the corresponding dispensing unit 12*a*. More particularly, it will be recalled that the gaming device 10 is operative to direct deposited coins to the hopper section 70 of the corresponding dispensing unit 12*a*, 12*b*, or 12*c* only if the number of coins in the hopper section of that denomination falls below a predetermined number. Thus, the hopper preset represents this predetermined number of coins which are to be maintained in the hopper section 70, whereas the hopper load register represents the number of coins which are actually present in the hopper section 70 at any instant.

In terms of the flow chart of FIG. 15*a*, the test of the hopper load register is indicated by diamond 268A and involves a comparison of the hopper load register for the A denomination coins with the hopper preset for the A denomination coins. If the test of this comparison is negative, indicating that the number of coins in the hopper section 70 of the corresponding dispensing unit 12*a* is not equal to the predetermined number of coins to be maintained in the hopper section 70, (i.e., it is less than the hopper preset), the hopper load register for the A denomination coin is indexed one unit, as indicated by the arrow 270A and rectangle 272A. On the other hand, if the test of the comparison of the hopper load register with the hopper preset indicates that the hopper load register equals the hopper preset (i.e., the number of coins in the hopper section 70 is at the predetermined level), the corresponding diverter solenoid 212 in the coin diverter mechanism 28 for the A denomination coins is activated, as indicated by the arrow 274A and the rectangle 276A. Activation of the diverter solenoid 212, as will be recalled, serves to extend the associated ram 214 thereof to move the lower end of the corresponding coin diverter chute 204 (e.g. 204*a*) to its raised position so as to be in alignment with the corresponding take chute 210 (e.g. 210*a*) to divert deposited coins into the take receptacle 200. If it is desired to maintain a running count of the number of coins in the take receptacle 200, during this last operation a take register for the A denomination coin could be indexed one unit.

Thus, it will be appreciated that in accordance with this sequence of operations as illustrated by the diamond 268A and rectangles 272A, 276A, the deposited coin will either be directed to the associated hopper section 70 of the associated dispensing unit 12*a* if the number of coins of that particular denomination which are in the hopper section 70 is less than the preset number, or will be directed to the take receptacle 200 if the number of coins in the hopper section 70 is at the predetermined number.

The next operation involves a test of whether the coin-in register for the A denomination coins is equal to a coin-in preset for the A denomination coins. More particularly, the gaming device 10 in accordance with the present invention, while it is operative to receive a plurality of coins of a particular denomination, is only operative to receive a selected number of such coins for a single play, for example, fifteen coins of a single denomination. Thus, once fifteen coins of a particular denomination have been deposited (i.e., the coin-in preset has been reached), the gaming device 10 operates to actuate a lock-out mechanism so that no more coins of that particular denomination may be received by the gaming device 10. Here, it will be appreciated that the preset number of coins of each of the different denominations may be selected differently or the same, and further may be varied by the owner or renter of the device 10. The lock-out mechanism (not shown) is associated with the coin acceptor mechanism 34, and when activated, simply serves to direct coins of that particular denomination to the coin return of the device 10, much in the same manner that slugs or bent coins are automatically rejected by coin acceptor mechanisms for vending machines.

In terms of the flow chart of FIG. 15*a*, the test of whether the number of coins of a particular denomination have already been received is indicated by the diamond 278A. This test involves a comparison of the coin-in register for the A denomination coin with the coin-in preset for the A denomination coins. If the test of diamond 278A is affirmative, indicating that the number of coins of that particular denomination which have been received equals the preset number, the coin acceptor mechanism is locked out for the A denomination coins, as indicated by the arrow 280A and the rectangle 282A. On the other hand, if the test of whether the coin-in register for the A denomination coin is equal to the coin-in preset for the A denomination coin, the gaming device 10 simply proceeds to the next operation, as indicated by the arrow 288A.

This sequence of operations with respect to an A denomination coin is simultaneously performed with respect to the B and C denomination coins, as indicated by the various diamonds, rectangles and arrows having the same reference characters but containing the letters B and C, respectively, thereafter. As the sequence of operations is the same for each denomination of coin, it is not necessary to precisely describe the different tests and operations which are performed with respect to the B and C denomination coins; the various operations are precisely the same except that they are being performed with respect to B and C denominations of coins, respectively. In this regard, it will further be noted that the tests indicated by the diamonds 256A, 256B and 256C are made simultaneously for each new coin which is deposited. However, the remaining operations will only be performed with respect to a single coin since the tests of the diamonds 256A, 256B, 256C are made when only one coin has been deposited and before any further coins are deposited. In other words, if the coin which has been deposited is a B denomination coin, the routine will proceed to index the coin-in register only for the B denomination coin, as indicated by the arrow 262B and rectangle 264B. However, since during this test the coin acceptor switches **222*a* and 222*c* for the A denomination and C denomination coins is negative, the routine will simply continuously repeat the tests of the diamonds 256A and 256C as indicated by the arrows 266A and 266C**.

After a coin has been deposited, the appropriate coin-in register indexed, and the comparisons of the hopper load register with the hopper preset and of the coin-in register with the coin-in preset, the gaming device 10 proceeds to test whether the handle 24 has been pulled forward to begin the play cycle. In terms of FIG. **15*a*, the program proceeds from one of the arrows 288A, 288B, or 288C, along the line 290 to the diamond 292 to test whether the handle 24 has been pulled forward. This test is accomplished by testing whether the switch or sensor device 25 has been tripped by pulling of the handle 24** forwardly.

If the test of the diamond 292 is negative (i.e., the handle 24 has not been pulled forward), the gaming device 10 tests whether the coin slot switch 220 is again activated by the depositing of a new coin. This is indicated by the arrow 294 and the diamond 296. If no new con has been deposited, the gaming device 10 simply continues to test whether the handle 24 is pulled forwardly, as indicated by the arrow 298. On the other hand, if a new coin has been deposited, the device 10 returns to test the denomination of the coin, index the appropriate coin-in register, etc., as indicated by the arrow 300 and the corresponding tests 256A, 256B and 256C, etc.

After one coin has been deposited into the gaming device 10, it will be recalled that the actuating mechanism 40 is coupled to the handle 24 (as indicated by the rectangle 250). Thus, when the handle 24 is then pulled forwardly, the arresting means will disengage from the reels 14 and the actuating mechanism 40 will be activated to cause the reels 14 to begin rotation. In terms of FIG. **15*a*, when the handle 24 is pulled forwardly, the test of the diamond 292 will be affirmative, and the play routine Y will be entered, as indicated by arrow 302 and the circular flag 304**.

The operations of the gaming device 10 when the play routine Y is entered are illustrated in FIG. **15*b*. More particularly, when the play routine Y is entered, as indicated by the circular flag 306, the arresting mechanisms are disengaged from the respective reels 14 so that the reels 14 may be spun freely upon rotation of the shaft 36. This for example is accomplished by activation of the solenoids 54 of each of the engaging means 50, and is indicated in FIG. 15*b* by the rectangle 308. Additionally, the actuating mechanism 40 is activated to couple the clutch mechanisms to the shaft 36 and to rotate the shaft 36 to begin each of the reels 14 spinning, as also indicated by the rectangle 308. Also at this same time, a suitable lock-out means is activated to lock out all further coin acceptability during a play routine, as also indicated by the rectangle 308. This, for example, may be accomplished by any suitable means for preventing deposited coins from passing to the coin diverter mechanism, such as through the use of the conventional coin return of the coin acceptor mechanism 34**.

As soon as the actuating mechanism 40 has been activated, and the reels 14 are spinning, the actuating mechanism 40 is decoupled from the handle 24 by engagement of suitable lock mechanisms so that no further actuation of the reels may take place after the handle 24 is pulled forwardly once. This is indicated by the rectangle 310 in FIG. **15*b*. Thereafter, the various arresting mechanisms (i.e., the solenoids 54) are actuated at appropriate variated intervals for arresting or stopping rotation of each of the reels 14 so as to display a symbol 16 on each of the reels 14 in the window 18 of the housing 20. In this regard, actuation of the respective solenoids 54 is preferably variable so as to provide variable generated combinations of symbols 16. This operation is indicated by the rectangle 312 in FIG. 15*b***.

After the rotation of the reels 14 has been arrested, the particular position of each of the reels 14 is then detected with the detecting means 66, the particular symbols 16 appearing in each of the windows 18 for each of the reels 14 then being suitably applied to the microprocessor unit. This is indicated by the rectangle 314. Once the position of each of the reels 14 has been detected, the machine 10 then determines whether the combination of the reel positions is a win combination or condition. If any particular combination produced by the reels 14 comprises a win condition, appropriate signals are generated for operating the appropriate coin dispensing units **12*a*, 12*b*, 12*c* to dispense an appropriate number of coins of a like denomination corresponding to the denomination and number of coins initially deposited. More particularly, certain possible combinations which may be generated by the combination of the three reels 14 are designated winning combinations or conditions. This particular winning combinations can be preselected by the owner of the gaming machine or device 10. In many instances, winning combinations comprise combinations in which the three symbols 16 forming the combination are the same, although a winning combination could comprise one particular symbol on one of the reels 14. If the combination of symbols 16 produced is not a winning combination, the gaming device 10 then generates a signal to clear to the coin-in registers and ready the gaming machine 10** for another play.

In terms of the flow chart of FIG. **15*b*, the test of whether the combination of reel positions is a win combination is made by the diamond 316. If this test is affirmative, the gaming machine 10 then proceeds to dispense an appropriate number of coins of each of the denominations of coins initially deposited, as indicated by the arrow 318. On the other hand, if the test of whether the combination of reel positions is a win combination is negative, the machine 10 is reset for the next play cycle by clearing of the appropriate coin-in registers, as indicated by the arrow 320 and the rectangle 322. Additionally, the power to the majority of the components is turned off after a preset period of time, such as for example, fifteen to thirty seconds as also indicated by the rectangle 322**.

If a winning combination has been sensed by the gaming device 10, as indicated by the arrow 318, the gaming device 10 then proceeds to activate the appropriate coin dispensing unit or units 12*a*, 12*b*, 12*c* to dispense coins. The particular coin dispensing unit or units 12*a*, 12*b*, 12*c* which are activated upon a win condition being sensed are those dispensing units 12*a*, 12*b* and 12*c* corresponding to the coins of the same denomination as the denomination of coins initially deposited in the device 10 for a particular play. In other words, if a player deposits one or more quarters into the gaming device 10, upon a win condition being sensed for a particular play, an appropriate signal will be generated for activating the quarter dispensing unit (e.g. 12*a*) to dispense quarters into the respective payout hopper (e.g., 26*a*). The gaming device 10 also maintains a count of the number of coins dispensed by the particular dispensing unit or units 12*a*, 12*b*, 12*c*, and when the appropriate number of coins have been dispensed, generates a signal to move the pin element 186 to its blocking position and to stop the motor 178 rotating the feed disc 134. In the preferred embodiment, as noted above, the motor 178 is actually reversed slightly. For instance, if a particular win combination is to pay fifty coins for each coin of that denomination inserted, for example to pay $12.50 for each quarter initially deposited, the gaming device 10 will function to terminate dispensing only after the dispensing unit (e.g., 12*a*) has dispensed fifty coins for each coin of that denomination which was initially deposited. Therefore, if a player has deposited four quarters, then 200 quarters would be dispensed into the quarter payout hopper (e.g., 26*a*) in the example give above.

With reference to the flow chart of FIG. 15*b*, after a winning combination has been sensed, the gaming device 10 proceeds along three separate paths, one for each of the different denominations of coins which are intended for use with the gaming device 10, (i.e., A denomination coins, B denomination coins, and the C denomination coins), to test whether coins of each of the different denominations was initially deposited for the play. In this regard, as each of the subsequent operations are the same for each of the different denominations of coins, only one set of operations (e.g. for the A denomination coins) will be described, it being understood that the operations for the other denominations of coins are similarly performed by the gaming device 10.

More particularly, the gaming device 10, after sensing that a win combination has been generated, initially tests whether the corresponding coin-in registers for each of the different denominations of coins zero. This is indicated by the diamonds 324A, 324B, and 324C. Each of these tests involves testing the state of the coin-in register for the particular denomination of coins. For example, with reference to the diamond 318A, the gaming device 10 tests whether the coin-in register for the A denomination coins is zero. It will be recalled that an A denomination coin had been inserted into the gaming device 10 initially, the coin-in register for the A denomination coin would be greater than zero, and in particular would represent the number of coins of the A denomination which had been inserted. If no A denomination coins had been inserted initially for the particular play cycle, the coin-in register for the A denomination coins would be zero. If the test of the diamond 318A is positive (i.e., no A denomination coins had been deposited) the gaming device 10 would proceed to set a flag for the A dispensing unit 12*a*, indicating that the coin-in register for the A dispensing unit 12*a* was zero, and return to Z, as indicated by the arrow 326A and rectangle 328A. The operation of the gaming device 10 when the gaming device returns to Z will be described more fully hereinbelow.

Assuming that the coin-in register for the A denomination of coins is not zero, i.e., that one or more coins of the A denomination had initially been deposited, the gaming device 10 proceeds to set a dispenser register for the A denomination of coins to a preselected value depending on the win condition, as indicated by the arrow 330A, and the rectangle 332A. The particular value at which the dispenser unit register is set is dependent on the particular win combination which was generated, and represents the odds at which the machine 10 will pay out for the particular combination. Here, it should be noted that the particular value is that the dispense register is set is not dependent on the number of coins of the particular denomination which were initially inserted, but simply represents the odds of pay out, for example, odds of 50-to-1 in the particular example given above for quarters. In this regard, the microprocessor unit contains appropriate information for setting the dispenser unit register at a preselected value, depending on the particular win combination.

The gaming device 10, after setting the dispenser register at the appropriate value then activates the dispensing unit 12*a* to turn on the feed disc 134 and move the pin element 186 to its unblocking position as indicated by the rectangle 334A. In this regard, it will be appreciated that movement of the pin element 186 is accomplished by actuation of one of the solenoids 194, and deactivation of the other solenoid 194. This operation causes the disc 134 to rotate and causes the pin member to move out of outlet slot 152 so that coins may be dispensed through the outlet slot 152 of the dispensing unit 12*a*. The gaming device 10 then proceeds to sense whether the coin counting mechanism 170 of the dispensing unit 12*a* has been activated or tripped, as indicated by the diamond 336A. Activation of the coin counter mechanism 170 indicates that a coin is being dispensed through the outlet slot 156. The test of the coin counter mechanism 170 is negative, the test is continuously repeated, as indicated by the arrow 338A, until the coin counting mechanism 170 is activated, as indicated by the arrow 340A. When the coin counting mechanism 170 is activated, the dispenser register for the particular denomination of coins is decremented one unit, as indicated by the arrow 342A and rectangle 342A. Additionally, the hopper load register is decremented one unit to indicate that the one less coin is in the hopper section 70, also as indicated by the rectangle 344A.

The gaming device 10 then proceeds to test whether the dispenser register for the A denomination coin is zero as indicated by the diamond 346A. If the dispenser register is not zero, the gaming machine simply proceeds to again test the coin counting mechanism 170, as indicated by the arrow 353A and diamond 336A. This sequence of operation is repeated until the dispenser register becomes zero. When the dispenser register is zero, the coin-in register for the A denomination coin is decremented one unit, as indicated by the arrow 348A and the rectangle 350A. Additionally, the motor 178 to the feed disc 134 is turned off and the pin element 186 is momentarily moved into its blocking position, as also indicated by the rectangle 350A. The coin-in register for the A denomination of coin is then tested again to determine whether the coin-in register for the A denomination of coin is zero, as indicated by the arrow 352A. This sequence of operations is continuously repeated until the coin-in register for the A denomination of coin is zero, at which time the flag for the A dispensing unit 12*a* is set, and the program returns to Z. Thus, it will be appreciated that in accordance with this technique, when more than one coin of a particular denomination is initially inserted, the dispensing unit 12*a* is simply actuated an appropriate corresponding number of times for the number of coins that have initially been inserted. In other words, the sequence or loop represented by the diamonds 324A through the rectangle 350A is simply repeated a number of times corresponding to the number of coins for that particular denomination which had been inserted. In this regard, since the different tests and operations ae performed quite rapidly, although rotation of the feed disc 134 is deactivated momentarily at the end of each pay cycle, it will again be activated if the coin-in register remains greater than zero. Otherwise, the feed disc 134 remains off and the pin element 186 remains in its blocking position. In essence, the dispensing unit 12*a* simply continues to dispense coins until the appropriate number of coins corresponding to the original number of that denomination inserted and to the preselected odds, have been dispensed. Of course, it will be appreciated that other sequences of operations could be provided in which rotation of the feed disc 134 is not momentarily terminated until all the coins of the appropriate denomination have been dispensed.

This operation of dispensing coins for each of the different denominations of coins occurs substantially simultaneously for each of the different denominations of coins which have been initially deposited. In other words, as the dispensing unit 12*a* for the A denomination of coins is being operated to dispense the appropriate number of coins of the A denomination upon a win condition being sensed, the B denomination of coins will similarly be dispensed by the dispensing unit 12*b*, and the C denomination of coins will be dispensed by the dispensing unit 12*c*, assuming of course that B and C denominations of coins were initially deposited.

After all these dispensing operations have been performed, the flags for each of the dispensing units 12*a*, 12*b*, and 12*c* (i.e., for the A denomination, the B denomination and the C denomination of coins) will be set, as indicated by the rectangles 328A, 328B and 328C, and the program entered at Z, as indicated by by the circular flag 354. When the Z routine is entered, the gaming device 10 initially tests whether the flags for the A dispensing unit 12*a*, the B dispensing unit 12*b* and the C dispensing unit 12*c* have all been set, as indicated by the diamond 356. If the flags for each of the dispensing units 12*a*, 12*b*, and 12*c* have not all been set, the test is simply repeated, as indicated by the arrow 358. Once all of the flags have been set, as indicated by the test of the diamond 350 being affirmative, the machine 10 is reset for the next play cycle and the power turned off after a preset period of time, as indicated by the arrows 360, 320 and the rectangle 322. This operation of resetting the machine 10 simply involves clearing each of the coin-in registers (which should be zero, in any event, for generation of the appropriate flags), clearing of the flags, and deenergizing those portions of the machine 10 which are normally to be maintained in an idle condition. In this regard, the hopper load register, the hopper preset register and coin preset registers will not be cleared, but will simply be maintained according to their adjusted values for the hopper load register, or for their preset values as initially selected by the owner of the machine 10.

The gaming device 10 is then ready for a subsequent play. For the next play, the player deposits one or more coins into the device 10, and the same sequence of operations as illustrated with reference to FIGS. 15*a* and 15*b* are repeated.

Thus, it should be appreciated that in accordance with the present invention, not only may more than one coin of the same denomination be inserted into the device 10 and to then pay out upon a winning condition being sensed a number of coins which correspond to such number in a predetermined manner (i.e., according to the preselected odds of a particular winning condition) but in addition, the gaming device 10 is adapted to receive one or more coins of different denominations. For instance, if a dime and a quarter were inserted into the device 10 before the handle 24 is pulled forwardly, and if a winning combination or condition were generated during the play, both the quarter dispensing unit, e.g., 12*a*, and the dime dispensing unit, e.g., 12*b*, would be activated to deposit coins in both the quarter and dime pay out hoppers 26*a*, 26*b*. In other words, the pay out of coins upon a winning condition being sensed comprises pay outs of coins in those denomination corresponding to the denominations initially deposited. Further, the number of coins of each denomination which are payed out correspond in a predetermined manner to the number of coins of each denomination inserted into the device 10. For example, if two quarters, three dimes and one nickel were initially inserted into the device 10, and a win condition is generated resulting in a twenty to one pay out ratio, then the gaming device 10 would operate to actuate each of the coin dispensing units 12*a*, 12*b*, 12*c* to pay out or dispense quarters, dimes and nickels into the pay out hoppers 26*a*, 26*b*, 26*c*. In particular, in the example given above, 40 quarters would be dispensed into the quarter payout hopper 26*a*, sixty dimes would be dispensed into the dime pay out hopper 26*b*, and 20 nickels would be dispensed into the nickel pay out hopper 26*c*.

Therefore, the gaming device 10 in accordance with the present invention may be operated either as a quarter machine, a dime machine, or a nickel machine, or as a combination quarter-dime-nickel machine, and the pay out, upon each win condition, will be made in like denominations of coins as initially deposited. This increases the flexibility of the machine 10 and also serves to provide a device by which variable bets may be placed by the players, thereby generating more interest in playing of the gaming device 10. Furthermore, as the gaming device 10 may be used as either a quarter, dime or nickel machine, the same gaming device 10 may be played by individuals of various degrees of financial capability, thereby rendering the gaming device 10 more adaptable to the financial conditions of the individuals, and thus increase the likelihood that the device 10 will be used, i.e., persons desiring to only place nickel bets will be able to use the device 10 as well as persons desiring to place quarter or even greater denomination bets.

Furthermore, it will be appreciated that in accordance with the present invention, the coins are dispensed during a pay out mode in a relatively short period of time, e.g., at a rate of 25 to 35 coins per second. This is most advantageous in that the entire pay out can be accomplished in a relatively short period of time, and thus the gaming device 10 placed back into operation for subsequent plays at a much quicker rate. Therefore, the number of plays which can be made with the gaming device 10 in a given period of time can be increased, and consequently the amount of take for the owner or renter of the device 10 may be increased.

Therefore, in accordance with one aspect of the present invention, there is provided a gaming device 10 which includes coin receiving means 30 for receiving different denominations of coins and for receiving one or more coins of each denomination, and chance means for generating one of a plurality of chance conditions, at least one of the chance conditions representing a win condition, and the chance means being responsive to the coin receiving means 30 receiving at least one coin. Sensing means 166 are provided for sensing when the chance means produces a winning condition are also provided. The gaming device 10 further includes a plurality of coin containing means or hopper sections 20 corresponding in number to the different denominations of coins intended to be received by the coin receiving means 30, each of the coin containing means or hoppers 20 containing a supply of one of the different denominations of coins, and coin determining means for determining the denomination of coins and the number of coins of each denomination received by the coin receiving means 30. These is also provided dispensing means 12*a*, 12*b*, and 12*c* for dispensing coins from the plurality of coin containing means 20 upon a win condition being sensed by the sensing means, the dispensing means 12*a*, 12*b*, 12*c* being responsive to the coin determining means to dispense coins from those of the coin containing means 20 which correspond respectively to each denomination of coins received by the coin receiving means 30, and the number of coins of each denomination being dispensed by the dispensing means 12*a*, 12*b*, 12*c* corresponding in a predetermined manner to the number of coins of each denomination received by the coin receiving means 30. In this manner, when a win condition is sensed, coins are dispensed of a like denomination as those received by the coin receiving means 30, and in a number corresponding to the number of coins of each denomination received by the coin receiving means 30.

In accordance with a further aspect of the present invention, there is provided a coin dispensing device 12*a*, 12*b* or 12*c* for dispensing coins of a predetermined width and thickness, which advantageously may be used in a gaming device 10 for dispensing coins during a pay out cycle at an increased rate. The coin dispensing device 12*a*, 12*b* or 12*c* comprises a hopper section 20 for storing a supply of coins to be dispensed, the hopper section 20 including the bottom guide means 120 having a circular opening 126 through which coins may be guided, the circular opening 126 being defined by a lower edge portion 132 and being of a first predetermined diameter. A rotatable feed disc 134 is arranged beneath the guide means 120 for rotation about an axis substantially coinciding with the axis of the circular opening of the guide means 120, the feed disc 134 including a central hub element 142 coaxially arranged with the axis of rotation of the feed disc 134 and extending above the upper surface 144 of the feed disc 134. The circular hub 142 is of a second predetermined diameter which is less than the first predetermined diameter by an amount which is approximately twice the predetermined width of the coins to be dispensed. The upper surface 144 of the feed disc 134 is spaced from a lower surface 138 of the guide means 120 a distance which is less than twice the predetermined thickness of the coins to be dispensed to define a coin passageway 150 between the feed disc 134 and the guide means 120 through which coins supported by the feed disc 134 may pass below the lower edge portion 132 of the guide means 120. Means 178 are provided for rotating the feed disc 134 to urge the coins thereon radially outward beneath the guide means 120. Further, closure means 140 are associated with the guide means 120 and the feed disc 134 for substantially enclosing the outer periphery of the coin passageway 150 between the feed disc 134 and the guide means 120, the closure means 140 including a lateral outlet slot 152 communicating with the passageway 150 between the feed disc 134 and the guide means 120 through which coins fed into the passageway 150 are directed upon rotation of the feed disc 134. With such a coin dispensing device 12*a*, 12*b* or 12*c*, coins may be rapidly and efficiently dispensed, one at a time, through the outlet slot 152.

While the preferred embodiment of the present invention has been shown and described, it will be understood that such are merely illustrative and that changes may be made without departing from the scope of the invention as claimed.

What is claimed is:

1. A coin dispensing device for dispensing coins of a predetermined width and thickness, said device comprising:

a hopper for storing a supply of coins to be dispensed, said hopper including bottom guide means for guiding of coins through the bottom of said hopper, said guide means including a lower edge portion defining a circular opening through which coins are to be guided, said circular opening being of a first predetermined diameter;

a rotatable feed disc arranged beneath said guide means for rotation about an axis substantially coinciding with the axis of said circular opening of said guide means, said feed disc including a circular hub element coaxially arranged with the axis of rotation of said feed disc and extending above the upper surface of said feed disc, said circular hub element being of a second predetermined diameter which is less than said first predetermined diameter by an amount which is approximately twice said predetermined width of said coins to be dispensed so as to define with said lower edge portion of said guide means an annular space above said feed disc for the receipt of coins to be dispensed, said upper surface of said feed disc being spaced from the lower surface of said lower edge portion of said guide means a distance which is less than twice said predetermined thickness of said coins to be dispensed, and said guide means and said feed disc defining a substantially annular coin passageway therebetween which is disposed radially outward from and around said annular space and into which coins supported by said feed disc in said annular space may pass beneath said lower edge portion of said guide means;

agitating and support means arranged in said hopper for supporting coins in said hopper above said agitating and support means and for directing coins in said hopper downwardly past said agitating and support means towards said annular space so as to be placed onto said feed disc;

means for rotating said feed disc to urge coins thereon in said annular space radially outward beneath said guide means into said coin passageway; and closure means associated with said guide means and said feed disc for substantially enclosing the outer periphery of said substantially annular coin passageway between said feed disc and said guide means, said closure means including a lateral outlet slot communicating with said coin passageway through which coins in said coin passageway are directed upon rotation of said feed disc.

2. The coin dispensing device of claim 1 wherein said guide means comprises a guide plate member having a circular opening therein, and having a lower surface which is arranged in spaced relationship to said upper surface of said feed disc, said lower edge portion of said guide plate member comprising a portion of said lower surface of said guide plate member.

3. The coin dispensing device of claim 2 wherein said closure means comprises a shoulder depending downward from said lower surface of said guide plate member and extending about the circumference of said feed disc, the lower edge of said shoulder being at an elevation below the elevation of said upper surface of said feed disc.

4. The coin dispensing device of claim 3 wherein said lateral outlet slot is at least partially defined by a circumferential portion of said circular shoulder of said guide plate member.

5. The coin dispensing device of claim 4 wherein said lateral outlet slot is also partially defined by a guide finger supported from said lower surface of said guide plate member, at least a portion of said guide finger extending inwardly from said shoulder of said guide plate member to intercept coins on said feed disc which have been fed into said coin passageway during rotation of said feed disc.

6. The coin dispensing device of claim 5 wherein the position of said guide finger is adjustable to vary the width of said lateral outlet slot to correspond to said predetermined width of said coins to be dispensed.

7. The coin dispensing device of claim 6 wherein said central hub element is removably supported by said feed disc.

8. The coin dispensing device of claim 1, wherein the minimum distance between the outer periphery and the inner periphery of said substantially annular coin passageway is at least as great as said predetermined width of said coins to be dispensed.

9. The coin dispensing device of claim 1 wherein said agitating and support means serves to direct and guide said coins in said hopper into an orientation so as to be placed substantially flat on said feed disc through said annular space between said circular hub element and said lower edge portion of said guide means.

10. The coin dispensing device of claim 9 wherein said agitating and support means comprises a fan-like agitator element having a plurality of circumferentially spaced blades and agitator element support means for supporting said agitator element so as to be substantially coaxial with said axis of rotation of said feed disc.

11. The coin dispensing device of claim 10 wherein said agitator element support means supports said agitating element for rotation about an axis coinciding with said axis of rotation of said feed disc.

12. The coin dispensing device of claim 11 wherein said agitator element support means supports said agitator element above said circular hub element so that when said feed disc is rotated, coins in said hopper above said feed disc are moved to thereby rotate said agitator element.

13. The coin dispensing device of claim 12 wherein said agitator element support means comprises a post adjustably mounted on said hopper so as to be coaxially arranged with respect to said axis of rotation of said feed disc, and wherein said agitator element is supported by said post so as to be rotatable with respect thereto about the axis of said post and so as to be movable along the length of said post.

14. The coin dispensing device of claim 8 wherein said agitating and support means serves to direct and guide said coins in said hopper into an orientation so as to be placed substantially flat on said feed disc through said annular space between said circular hub element and said lower edge portion of said guide means.

15. The coin dispensing device of claim 14 wherein said agitating and support means comprises a fan-like agitator element having a plurality of circumferentially spaced blades, and agitator element support means for supporting said agitator element so as to be substantially coaxial with said axis of rotation of said feed disc.

16. The coin dispensing device of claim 15, wherein said agitator element support means supports said agitating element for rotation about an axis coinciding with said axis of rotation of said feed disc.

17. The coin dispensing device of claim 16 wherein said agitator element support means supports said agitator element above said circular hub element so that when said feed disc is rotated, coins in said hopper above said feed disc are moved to thereby rotate said agitator element.

18. The coin dispensing device of claim 17 wherein said agitator element support means comprises a post adjustably mounted on said hopper so as to be coaxially arranged with respect to said axis of rotation of said feed disc, and wherein said agitator element is supported by said post so as to be rotatable with respect thereto about the axis of said post and so as to be movable along the length of said post.

19. The coin dispensing device of claim 8 wherein said hopper is disposed in a vertical orientation, and wherein said upper surface of said feed disc extends substantially horizontal and said feed disc is positioned vertically beneath said guide means of said hopper.

20. The coin dispensing device of claim 8 wherein the upper surface of said feed disc comprises a high friction surface.

21. The coin dispensing device of claim 20 wherein said upper surface of said feed disc comprises a neoprene rubber material.

22. The coin dispensing device of claim 8 further including coin counting means associated with said outlet slot for counting coins which are fed through said outlet slot.

23. The coin dispensing device of claim 22 wherein said coin counting means comprises a photocell and light center combination.

24. The coin dispensing device of claim 22 further including blocking means which is movable between a first position in which said blocking means is positioned in blocking relationship to said outlet slot to prevent passage of coins through said outlet slot and a second position in which said blocking means is positioned out of blocking relationship to said outlet slot to permit coins to pass through said outlet slot.

25. The coin dispensing device of claim 24 wherein said blocking means comprises a pin member and pin member moving means carrying said pin member, said pin member moving means being actuable to move said pin member between said first and second positions.

26. In a gaming device of the type including chance means for randomly generating one of a plurality of chance conditions, at least one of said chance conditions representing a win condition, sensing means for sensing when said chance means produces a win condition, and dispensing means for dispensing coins of a predetermined width and thickness in response to said sensing means sensing when said chance means produces a win condition, the improvement comprising said coin dispensing means comprising:

a hopper for storing a supply of said coins to be dispensed, said hopper including bottom guide means for guiding of coins through the bottom of said hopper, said guide means including a lower edge portion defining a circular opening through which coins are to be guided, and said circular opening being of a first predetermined diameter;

a rotatable feed disc arranged vertically beneath said guide means for rotation about an axis substantially coinciding with the axis of said circular opening of said guide means, said feed disc including a circular hub element coaxially arranged with the axis of rotation of said feed disc and extending above the upper surface of said feed disc, said circular hub element being of a second predetermined diameter which is less than said first predetermined diameter by an amount which is approximately twice said predetermined width of said coins to be dispensed so as to define with said lower edge portion of said guide means an annular space above said feed disc for the receipt of coins to be dispensed, said upper surface of said feed disc being spaced from the lower surface of said lower edge portion of said guide means a distance which is less than twice said predetermined thickness of said coins to be dispensed, and said guide means and said feed disc defining a substantially annular coin passageway therebetween which is disposed radially outward from and around said annular space and into which coins supported by said feed disc in said annular space may pass beneath said lower edge portion of said guide means;

agitating and support means arranged in said hopper for supporting coins in said hopper above said agitating and support means and for directing coins in said hopper downwardly past said agitating and support means towards said annular space so as to be placed onto said feed disc;

means for rotating said feed disc to urge coins thereon in said annular space radially outward beneath said guide means into said coin passageway; and closure means associated with said guide means and said feed disc for substantially enclosing the outer periphery of said substantially annular coin passageway between said feed disc and said guide means, said closure means including a lateral outlet slot communicating with said coin passageway through which coins in said coin passageway are directed upon rotation of said feed disc.

27. The gaming device of claim 26 wherein the minimum distance between the outer periphery and the inner periphery of said substantially annular coin passageway is at least as great as said predetermined width of said coins to be dispensed.

28. The gaming device of claim 26 wherein said agitating and support means serves to direct and guide said coins in said hopper into an orientation so as to be placed substantially flat on said feed disc through said annular space between said circular hub element and said lower edge portion of said guide means.

29. The gaming device of claim 28 wherein said agitating and support means comprises a fan-like agitator element having a plurality of circumferentially spaced blades and agitator element support means for supporting said agitator element so as to be substantially coaxial with said axis of rotation of said feed disc.

30. The gaming device of claim 27 wherein said agitating and support means serves to direct and guide said coins in said hopper into an orientation so as to be placed substantially flat on said feed disc through said annular space between said circular hub element and said lower edge portion of said guide means.

31. The gaming device of claim 30 wherein said agitating and support means comprises a fan-like agitator element having a plurality of circumferentially spaced blades, and agitator element support means for supporting said agitator element so as to be substantially coaxial with said axis of rotation of said feed disc.

32. The gaming device of claim 27 wherein said hopper is disposed in a vertical orientation, and wherein said upper surface of said feed disc extends substantially horizontal and said feed disc is positioned vertically beneath said guide means of said hopper.

33. The gaming device of claim 27 wherein said guide means comprises a guide plate member having a circular opening therein, and having a lower surface which is arranged in spaced relationship to said upper surface of said feed disc, said lower edge portion of said guide plate member comprising a portion of said lower surface of said guide plate member; and wherein said closure means comprises a shoulder depending downward from said lower surface of said guide plate member and extending about the circumference of said feed disc, the lower edge of said shoulder being at an elevation below the elevation of said upper surface of said feed disc.

34. The gaming device of claim 33 wherein said lateral outlet slot is partially defined by a guide finger supported from said lower surface of said guide plate member, at least a portion of said guide finger extending inwardly from said shoulder of said guide plate member to intercept coins on said feed disc which have been fed into said coin passageway during rotation of said feed disc.

35. The gaming device of claim 34 wherein the position of said guide finger is adjustable to vary the width of said lateral outlet slot to correspond to said predetermined width of said coins to be dispensed.

36. The gaming device of claim 27 further including coin counting means associated with said outlet slot for counting coins which are fed through said outlet slot.

37. The gaming device of claim 36 further including blocking means which is movable between a first position in which said blocking means is positioned in blocking relationship to said outlet slot to prevent passage of coins through said outlet slot and a second position in which said blocking means is positioned out of blocking relationship to said outlet slot to permit coins to pass through said outlet slot.

38. A coin dispensing device for dispensing coins of a predetermined width and thickness, said device comprising:

a hopper for storing a supply of coins to be dispensed, said hopper including bottom guide means for guiding of coins through the bottom of said hopper, said guide means including a lower edge portion defining a circular opening through which coins are to be guided, said circular opening being of a first predetermined diameter;

a rotatable feed disc arranged beneath said guide means for rotation about an axis substantially coinciding with the axis of said circular opening of said guide means, said feed disc including a circular hub element coaxially arranged with the axis of rotation of said feed disc and extending above the upper surface of said feed disc, said circular hub element being of a second predetermined diameter which is less than said first predetermined diameter by an amount which is approximately twice said predetermined width of said coins to be dispensed so as to define with said lower edge portion of said guide means an annular space above said feed disc for the receipt of coins to be dispensed, said upper surface of said feed disc being spaced from the lower surface of said lower edge portion of said guide means a distance which is less than twice said predetermined thickness of said coins to be dispensed to define a coin passageway between said feed disc and said guide means through which coins supported by said feed disc may pass beneath said lower edge portion of said guide means;

means for rotating said feed disc to urge coins thereon radially outward beneath said guide means;

agitating and support means arranged in said hopper for supporting coins in said hopper above said agitating and support means and for directing coins in said hopper downwardly past said agitating and support means towards said annular space and for directing and guiding said coins into an orientation so as to be placed substantially flat on said feed disc between said circular hub element and said lower edge portion of said guide means, said agitating and support means comprising a fan-like agitator element having a plurality of circumferentially spaced blades and agitator element support means for supporting said agitator element so as to be substantially coaxial with said axis of rotation of said feed disc; and closure means associated with said guide means and said feed disc for substantially enclosing the outer periphery of said coin passageway between said feed disc and said guide means, said closure means including a lateral outlet slot communicating with said coin passageway through which coins fed into said coin passageway are directed upon rotation of said feed disc.

39. The coin dispensing device of claim 38 wherein said agitator element support means supports said agitating element for rotation about an axis coinciding with said axis of rotation of said feed disc.

40. The coin dispensing device of claim 39 wherein said agitator element support means supports said agitator element above said circular hub element so that when said feed disc is rotated, coins in said hopper above said feed disc are moved to thereby rotate said agitator element.

41. The coin dispensing device of claim 40 wherein said agitator element support means comprises a post adjustably mounted on said hopper so as to be coaxially arranged with respect to said axis of rotation of said feed disc, and wherein said agitator element is supported by said post so as to be rotatable with respect thereto about the axis of said post and so as to be movable along the length of said post.

42. In a gaming device of the type including chance means for randomly generating one of a plurality of chance conditions, at least one of said chance conditions representing a win condition, sensing means for sensing when said chance means produces a win condition, and dispensing means for dispensing coins of a predetermined width and thickness in response to said sensing means sensing when said chance means produces a win condition, the improvement comprising said coin dispensing means comprising:

a hopper for storing a supply of said coins to be dispensed, said hopper including bottom guide means for guiding of coins through the bottom of said hopper, said guide means including a lower edge portion defining a circular opening through which coins are to be guided, said circular opening being of a fist predetermined diameter;

a rotatable feed disc arranged beneath said guide means for rotation about an axis substantially coinciding with the axis of said circular opening of said guide means, said feed disc including a circular hub element coaxially arranged with the axis of rotation of said feed disc and extending above the upper surface of said feed disc, said circular hub element being of a second predetermined diameter which is less than said first predetermined diameter by an amount which is approximately twice said predetermined width of said coins to be dispensed so as to define with said lower edge portion of said guide means an annular space above said feed disc for the receipt of coins to be dispensed, said upper surface of said feed disc being spaced from the lower surface of said lower edge portion of said guide means a distance which is less than twice said predetermined thickness of said coins to be dispensed to define a coin passageway between said feed disc and said guide means through which coins supported by said feed disc may pass beneath said lower edge portion of said guide means;

means for rotating said feed disc to urge coins thereon radially outward beneath said guide means;

agitating and support means arranged in said hopper for supporting coins in said hopper above said agitating and support means and for directing coins in said hopper downwardly past said agitating and support means towards said annular space and for directing and guiding said coins into an orientation so as to be placed substantially flat on said feed disc between said circular hub element and said lower edge portion of said guide means, said agitating and supporting means comprising a fan-like agitator element having a plurality of circumferentially spaced blades and agitator element support means for suporting said agitator element so as to be substantially coaxial with said axis of rotation of said speed disc; and closure means associated with said guide means and said feed disc for substantially enclosing the outer periphery of said coin passageway between said feed disc and said guide means, said closure means including a lateral outlet slot communicating with said coin passageway through which coins fed into said coin passageway are directed upon rotation of said feed disc.

* * * * *